US006664992B1

(12) United States Patent
Yokoyama et al.

(10) Patent No.: US 6,664,992 B1
(45) Date of Patent: Dec. 16, 2003

(54) DEVICE FOR MAKING A MASTER

(75) Inventors: Yasumitsu Yokoyama, Miyagi (JP); Yasunobu Kidoura, Miyagi (JP); Satoshi Katoh, Miyagi (JP); Yoshiyuki Shishido, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/528,032

(22) Filed: Mar. 17, 2000

(30) Foreign Application Priority Data

May 21, 1999 (JP) ..... 11-141632

(51) Int. Cl.[7] ..... B41J 2/335
(52) U.S. Cl. ..... 347/208; 347/201
(58) Field of Search ..... 347/208, 200, 347/201, 205

(56) References Cited

FOREIGN PATENT DOCUMENTS

| | | | |
|---|---|---|---|
| FR | 2471864 | * | 6/1981 |
| JP | 3-499962 | * | 3/1991 |
| JP | 8-067061 | | 3/1996 |
| JP | 11-077949 | | 3/1999 |
| JP | 11-147304 | * | 6/1999 |

* cited by examiner

*Primary Examiner*—Huan Tran
(74) *Attorney, Agent, or Firm*—Oblon, Spivak, McClelland, Maier & Neustadt, P.C.

(57) ABSTRACT

A master making device includes a thermal head with heat generating elements and a platen roller. While the head and platen roller convey a thermosensitive medium in a sub-scanning direction perpendicular to a main scanning direction, the heat generating elements selectively generate heat in order to perforate the medium in accordance with an image signal. The head includes a stepped portion formed at a medium outlet side in the subscanning direction. The edges of the heat generating elements adjoining the medium outside side are located at a distance of 0.018 mm to 0.5 mm from the end of the stepped portion adjoining the above edges. It is not necessary to position the head with respect to an effective nip between it and the platen roller by a troublesome procedure. Further, the distance over which the perforated medium is conveyed is reduced to obviate the reduction or contraction of an image ascribable to the sticking of the medium to the head.

15 Claims, 18 Drawing Sheets

DEVICE FOR MAKING A MASTER

BACKGROUND OF THE INVENTION

The present invention relates to a device for making a master and more particularly to a master making device including a thin film thermal head for making a master by using a thermosensitive stencil or similar thermosensitive medium.

It has been customary to record an image on a thermosensitive recording sheet, stencil or similar thermosensitive medium or make a master out of such a medium by using a thin film thermal head. A so-called planar thermal head, which is a specific form of the thin film thermal head, has a base formed of aluminum and generally referred to as a heat radiator at its bottom. A thin film substrate is formed on the base and formed of alumina ceramics. A heat insulation layer or glaze layer is formed on the thin film substrate and formed of glass. A resistance layer, which generates heat, is formed on the heat insulation layer and formed of a tantalum (Ta) alloy. A common electrode and discrete electrodes, constituting lead electrodes in combination, are deposited on the resistance layer. Portions of the resistance layer surrounded by the common electrode and discrete electrodes constitute heat generating elements arranged in an array in the main scanning direction of the head.

The above planar thermal head is a typical thin film thermal head and easy to produce and low cost. A master making device using the planar thermal head forms part of a digital stencil printer or digital thermal printer and is well known as a simple printing system. A thermosensitive stencil for use in this type of printing device is implemented as a laminate made up of an extremely thin film formed of polyester or similar thermoplastic resin, a porous base, and an adhesive layer adhering them together. The base is implemented by vynilon fibers, polyethylene terephthalate (PET) fibers or similar synthetic fibers, or Japanese paper fibers, flax fibers or similar natural fibers, or a mixture of Japanese paper fibers and synthetic fibers.

It has recently been proposed to use a 30 $\mu$m to 30 $\mu$m thick stencil thinner than the conventional stencil (about 40 $\mu$m to about 50 $\mu$m thick) although not as thin as a stencil substantially consisting of a thermoplastic resin film only (about 1 $\mu$m to 8 $\mu$m thick), and including a porous base containing a great amount of synthetic fibers. The entire porous base of this kind of stencil may be implemented by PET. However, such a stencil brings about a problem when applied to the master making device of a digital stencil printer, as follows. When a platen roller in rotation conveys the stencil, the thermosensitive film of the stencil melted by heat sticks to the surface of the heating generating elements of the head and cannot be conveyed by the platen roller over an expected master making distance, causing a reduced image to be formed in the stencil. This obstructs the faithful reproduction of an image.

To solve the above sticking problem, the following measures (1) through (4) have been proposed:

(1) to apply a lubricant containing, e.g., silicone (Si) to the surface of the stencil expected to contact the head;

(2) to increase the amount of natural fibers contained in the porous base of the stencil for thereby increasing friction to act between the platen roller and the stencil;

(3) to increase the above friction by increasing pressure to act between the platen roller and the head or by increasing the outside diameter of the platen roller; and (4) to shift the heat generating elements of the head toward the stencil outlet side in an effective nip width formed between the platen roller and the head.

However, the measure (1) causes the lubricant to adhere to and accumulate on a protection layer covering the heat generating elements. Such lubricant reduces the thermal conductivity of the heat generating elements and thereby degrades image quality. Further, during master making or printing operation, the above lubricant melts due to heat generated by the heat generating elements and is forced out toward the stencil outlet side of the head due to the conveyance of the stencil. Subsequently, the lubricant is cooled off and solidified as it moves away from the heat generating elements. Particularly, when a solid image, for example, is continuously formed in a thermosensitive stencil having relatively low mechanical strength by the head of a digital stencil printer, the above repeatedly occurs. As a result, the solidified lubricant accumulates on a common electrode positioned at the stencil outlet side of the head, raising the stencil above the head. The resulting clearance obstructs the heat transfer from the heat generating elements to the stencil and thereby disturbs the master making operation or the printing operation.

The measure (2) is undesirable because natural fibers are susceptible to environmental conditions including humidity. Therefore, the stencil becomes more susceptible to ambient humidity as the amount of natural fibers contained in the porous support increases, degrading the surface smoothness of the stencil and therefore image quality accordingly. This is apt to lower a so-called perforation probability.

The problem with the measure (3) is that an increase in the pressure of the platen roller directly translates into an increase in the mechanical stress to act on the head. This is apt to reduce the service life of the head by, e. g., causing the protection film of the head to come off. On the other hand, the diameter of the platen roller is, in many cases, determined by the size of the thin film substrate of the head. The platen roller therefore cannot have a diameter greater than the upper limit. Moreover, the current trend is toward a smaller thin film substrate capable of noticeably reducing the cost of the head and therefore toward a smaller platen roller diameter. The platen roller diameter therefore cannot be increased beyond a certain limit.

As for the measure (4), the effective nip width noticeably varies in accordance with the instantaneous platen roller pressure as well as platen roller specification including diameter, rubber thickness and rubber hardness. It is therefore difficult to adjust the position of the heat generating elements of the head, taking account of the variation of the effective nip width. Stated another way, because the effective nip width varies every time the pressure and/or the specification of the platen roller is changed, the heat generating elements must be shifted each time. Furthermore, because the effective nip width finely varies due to the platen roller in rotation or the stencil in movement, it is extremely difficult to so position the heat generating elements as to implement optimal perforations in any possible condition.

To reduce the size of the thin film substrate, it is desirable to cut the head from the protection layer to the substrate at a position as close to the heat generating elements at possible. However, because cutting even the substrate of the head by etching is difficult, a cutting device is required which would lower production efficiency and increase the cost. Moreover, the cutting device leaves noticeable burr on the cut end of the substrate and is therefore required to cut the substrate at a particular position with respect to the heat generating elements. In addition, burr is apt to scratch or otherwise damage the film surface of the thermosensitive medium.

Presumably, the above problems occur more or less with all kinds of stencils of the type including a film.

Technologies relating to the present invention are disclosed in, e.g., Japanese Patent Laid-Open Publication Nos. 8-67061 and 11-77949.

SUMMARY OF THE INVENTION

It is therefore an object of the present invention to provide a master making device obviating a troublesome procedure for positioning the heat generating elements of a thermal head in an effective nip width, and reducing the distance over which a thermosensitive medium is conveyed by being nipped between a platen roller and a thermal head after perforation to thereby obviate a reduced image ascribable to sticking.

It is another object of the present invention to provide a master making device allowing the thin film substrate of a thermal head to be cut without any bur while preventing production efficiency from decreasing and cost from increasing, and protecting the film surface of a thermosensitive medium from damage ascribable to burr.

In accordance with the present invention, a device for perforating a thermosensitive medium in accordance with an image signal to thereby make a master includes a thermal head including a plurality of heat generating elements arranged on a thin film substrate in an array in the main scanning direction. A platen roller presses the medium against the thermal head while in rotation for thereby conveying the medium in the subscanning direction perpendicular to the main scanning direction. The heat generating elements selectively generate heat in accordance with the image signal to thereby perforate the medium. The heat generating elements each have an edge thereof, which adjoins the end of the thin film substrate at a medium outlet side in the subscanning direction, located at a distance of 0 mm to 0.5 mm from the end of the substrate.

The thermal head may be formed with a stepped portion at the medium outlet side in the subscanning direction. In such a case, the edges of the heat generating elements adjoining the medium outlet side are located at a distance of 0.018 mm to 0.5 mm from the end of the stepped portion adjoining the above edges.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, the previously discussed conventional technologies will be described more specifically with reference to the accompanying drawings. First, the planar thermal head belonging to a family of thin film thermal heads will be described with reference to FIGS. 1 through 4.

Figure 1:
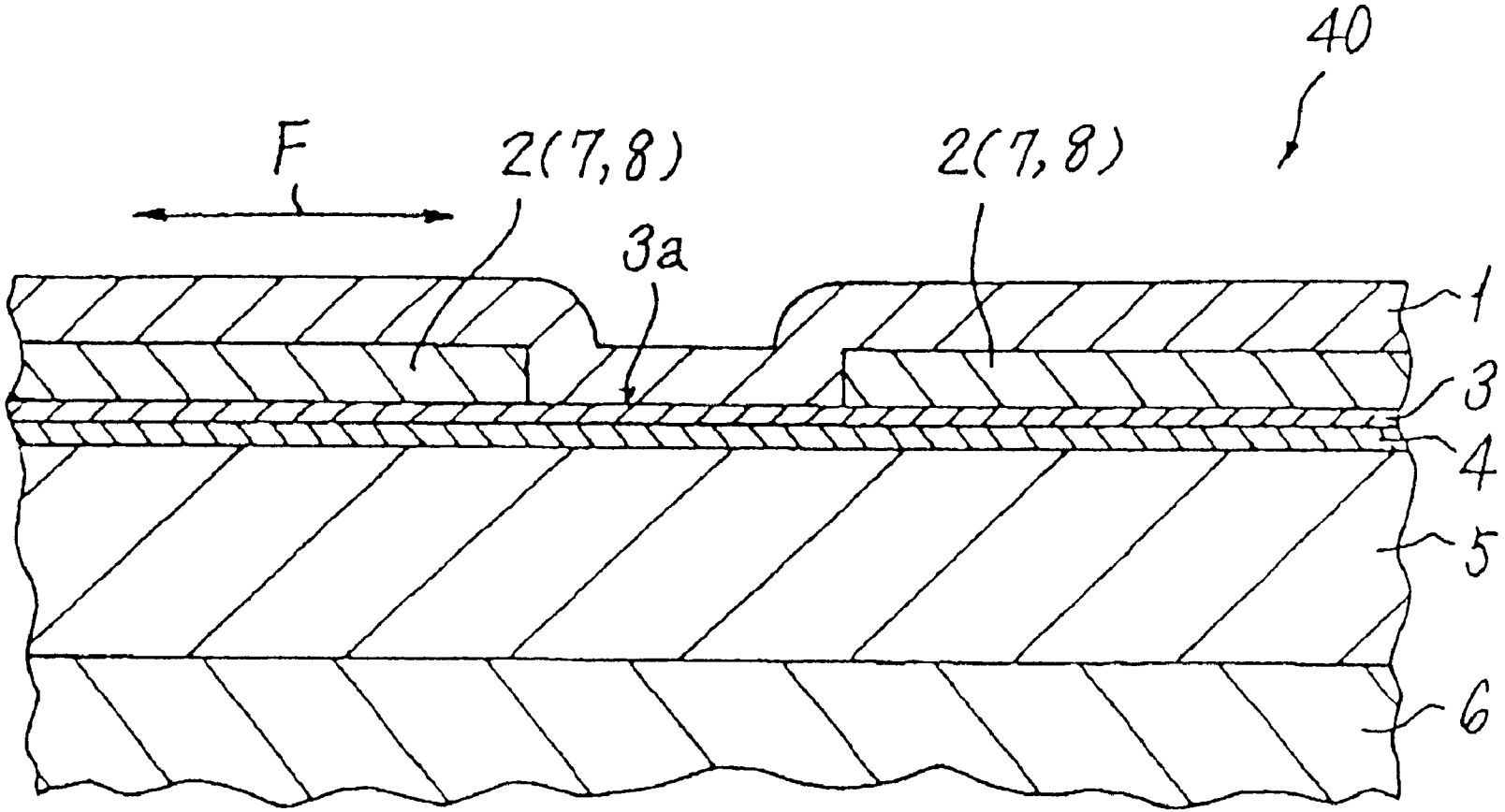
FIG. 1 PRIOR ART
FIG. 1 is a fragmentary section showing a planar thermal head included in a conventional master making device.

FIG. 1 shows the planar thermal head, generally 40, in a section in a subscanning direction F, i.e., a direction in which a thermosensitive medium is fed. As shown, the head 40 has a base or heat radiator 6 formed of aluminum at its bottom. A thin film substrate 5 is formed on the base 6 and formed of alumina ceramics. A heat insulation layer or glaze layer 4 is formed on the substrate 5 and formed of glass. A resistance layer 3, which generates heat, is formed on the heat insulation layer 4 and formed of a Ta alloy. A common electrode 7 and discrete electrodes 8, which are collectively referred to as lead electrodes 2, are deposited on the resistance layer 8.

Figure 2:
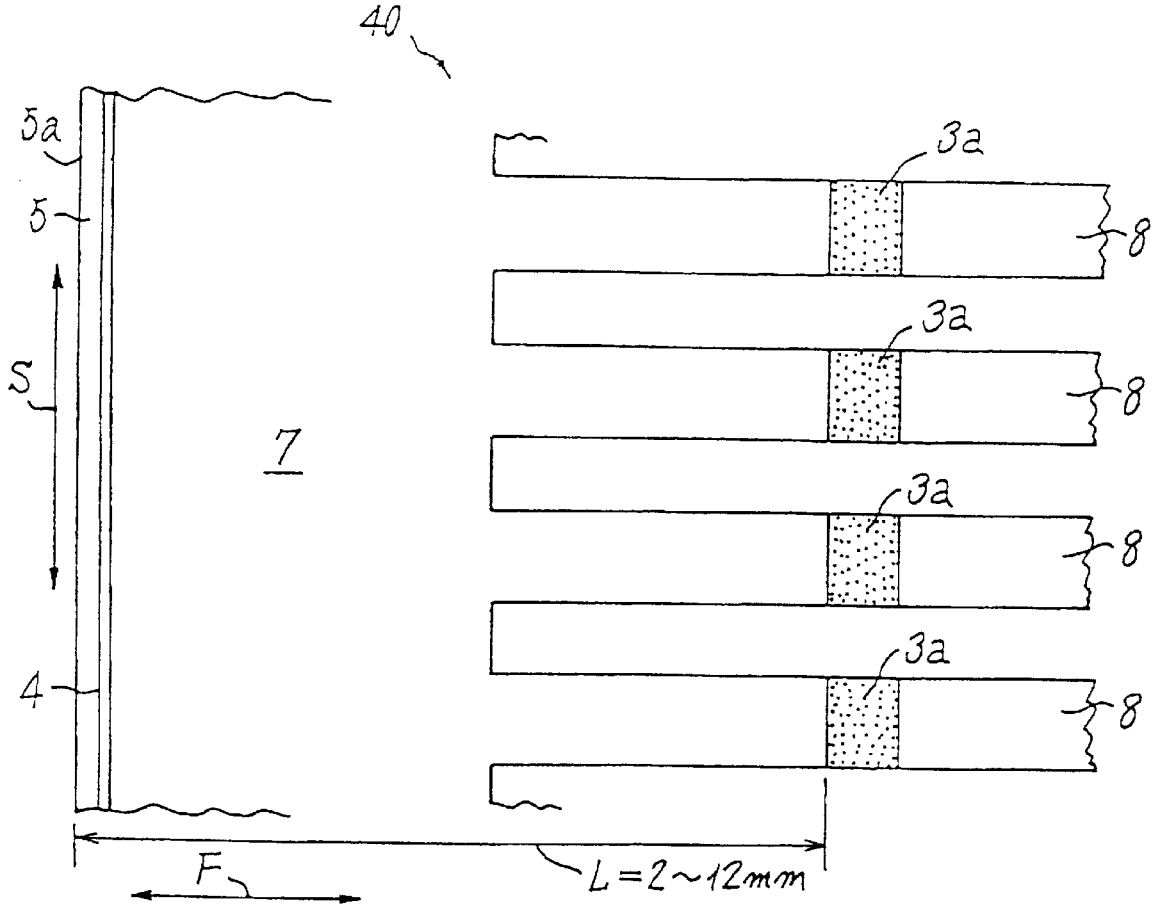
FIG. 2 PRIOR ART
FIG. 2 is a fragmentary plan view showing the arrangement of heat generating elements, a common electrode and discrete electrodes included in the thermal head of FIG. 1.

As shown in FIG. 2, the resistance layer 3 includes portions 3*a* surrounded by the common electrode 7 and discrete electrodes 8, as indicated by dots. The portions 3*a* are formed by etching and generally referred to as heat generating elements or devices or heating resistor regions. In this specific configuration, each heat generating element 3*a* is rectangular, as seen in a plan view. The heat generating elements 3*a* are formed by the common electrode 7 and discrete electrodes 8 connected to opposite sides of the resistance layer 3, respectively. A plurality of heat generating elements 3*a* are arranged in an array in the main scanning direction S of the head 40, as illustrated. Each heat generating element 3*a* is connected to a particular driver, not shown, via the associated discrete electrode 8.

As shown in FIG. 1, a protection layer 1 is formed on the heat generating elements 3*a*, common electrode and discrete electrodes 8, i.e., on the top of the head 40 by the deposition of an Si—O—N compound. The common electrode 7 has as great a width as possible in consideration of a common drop to occur when all the heat gneerating elements 3*a* are energized at the same time. As shown in FIG. 2, the thin film substrate 5 has an end face 5*a*.

The drivers selectively feed current between the common electrode 7 and the discrete electrodes 8 at a preselected line period. The resulting electric energy is transformed to thermal energy by the heat generating elements 3*a*. At this instant, Joule heat is generated by current flowing through the elements 3*a* with the result that heat is transferred to a thermosensitive medium contacting the elements 3*a* via the protection layer 1. Consequently, information is thermally printed on the medium (thermosensitive sheet) or thermally formed in the medium (thermosensitive stencil).

Figure 3:
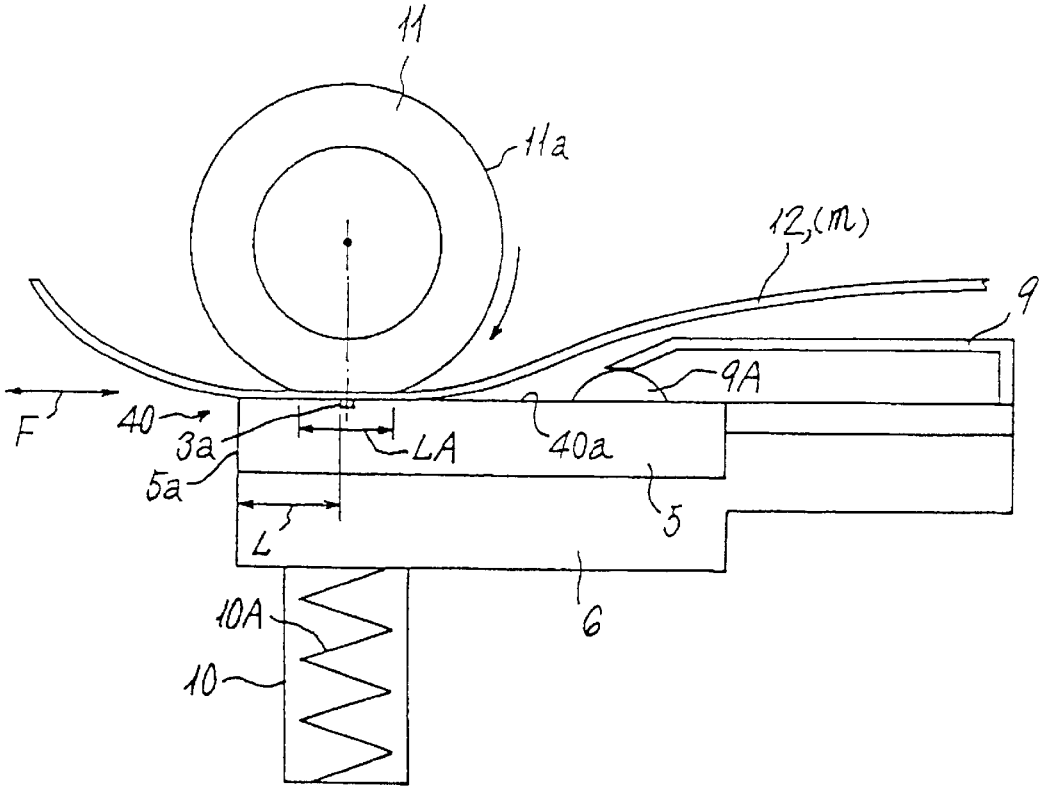
FIG. 3 PRIOR ART
FIG. 3 is a fragmentary front view showing the arrangement of the conventional master making device including the thermal head and a platen roller.

FIG. 3 shows a master making device including the above head 40 and forming part of a digital thermal stencil printer, as stated earlier. As shown, a thermosensitive stencil 12 is paid out from a stencil roll not shown. The top 40 a of the head 40 is pressed against the circumferential surface 11*a* of a platen roller 11 with the intermediary of the stencil 12. The heat generating elements 3*a* of the head 40 are selectively energized by pulses in response to a command output from a control unit, not shown, and caused to generate heat thereby. In this condition, the platen roller 11 conveys the stencil 12 in the subscanning direction F that will sometimes be referred to as a direction of stencil conveyance hereinafter. As a result, the stencil 12 is perforated by heat in accordance with an image signal and becomes a master. The master, also labeled 12, is automatically conveyed to and wrapped around a porous cylindrical print drum not shown. A press roller or similar pressing means, not shown, continuously presses a paper or similar recording medium against the print drum. Consequently, ink is transferred from the print drum to the paper via the perforations of the master 12, printing an image on the paper.

As also shown in FIG. 3, a pressing mechanism 10 including a compression coil spring 10A presses the head 40 against the platen roller 11 via the stencil 12. Protection resin 9A protects the drivers. A protection cover 9 protects the drivers and other electronic parts underlying the protection resin 9A.

Figure 4:
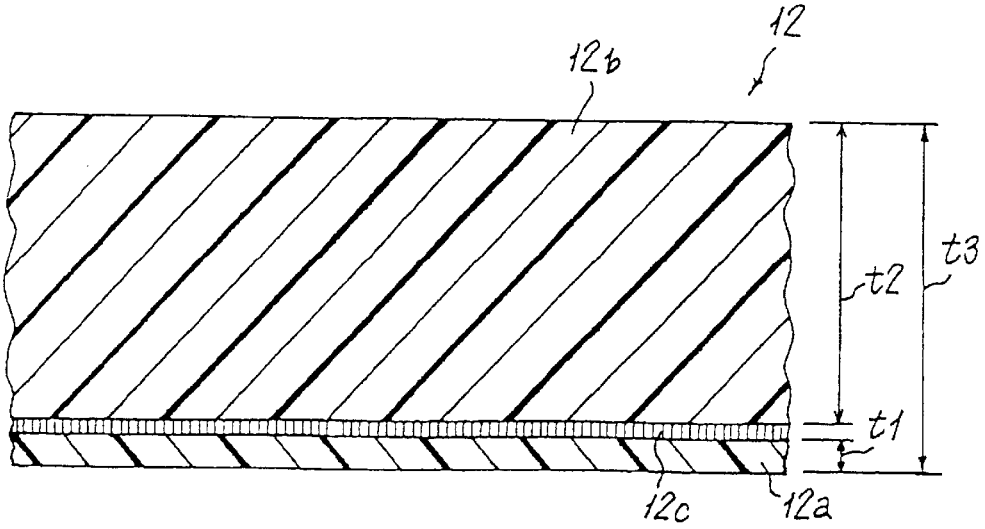
FIG. 4 is a fragmentary section of a stencil applicable to various illustrative embodiments of the master making device in accordance with the present invention.

As shown in FIG. 4, the stencil 12 is implemented as a laminate made up of an extremely thin film 12 a formed of polyester or similar thermoplastic resin, a porous base 12*b*, and an adhesive layer 12*c* adhering the film 12*a* and base 12*b*. The base 12*b* is implemented by vynilon fibers, PET fibers or similar synthetic fibers, or Japanese paper fibers, flax fibers or similar natural fibers, or a mixture of Japanese paper fibers and synthetic fibers. The base 12*b* may alternatively be implemented only by PET not containing flax or similar natural fibers or vynilon or only by a mixture of natural fibers and PET fibers.

The film 12*a* and base 12*b* usually have a thickness t1 of 1 $\mu$m to 2 $\mu$m and a thickness t2 of 20 $\mu$m to 50 $\mu$m, respectively. Therefore, the smoothness of the surface of the film 12*a* is effected by the base 12*b*. The base 12*b*, serving to provide the stencil 12 with mechanical strength, causes the above surface smoothness to vary because the base 12*b* is, in many cases, implemented by a mixture of flax or similar natural fibers and PET or vynilon. This is particularly true when the base 12*b* includes a great amount of natural fibers that are apt to expand or contract due to varying ambient conditions including humidity. To cope with the variation of the surface of the film 12*a*, various factors particular to the master making section of the printer are so selected as to make an effective nip with LA (see FIG. 3) over which the platen roller 11 and head 40 contact each other via the stencil 12 as broad as possible. The above factors include a pressure of 1.5 N/cm to 3.5 N/cm, rubber hardness Hs of the platen roller 11 ranging from 33° to 43° (JIS (Japanese Industrial Standards) A scale), rubber thickness of the roller 11 between 2 mm and 6 mm, and outside diameter of the roller 11 between 12 mm and 24 mm. Consequently, the effective nip width LA ranges from about 1.4 mm to about 4.0 mm, as will be described more specifically later. Further, the effective nip width LA varies due to, e.g., the dimensional scatter of the head 4 and the scatter of the pressure of the pressing mechanism 10. In light of this, the array of the heat generating elements 3*a* is usually located at the center of the effective nip width LA, i.e., at the center of the platen roller 11.

It has recently been proposed to increase the amount of synthetic fibers contained in the base 12*b* to an extreme degree in order to enhance image quality, as discussed earlier. This, however, brings about the previously stated sticking problem. Specifically, the base 12*b* with such a texture has its film 12*a* selectively perforated by the heat generating elements 3*a* of the head 40 and is conveyed by the platen roller 11 while being sandwiched between the roller 11 and the head 40 over a distance of about 0. 7 mm to 2.0 mm. This distance extends from the center of the heat generating elements 3*a* to the trailing end of the effective nip width LA in the subscanning direction or direction of stencil conveyance F. As a result, the film 12*a* melted by the elements 3*a* sticks to the surfaces of the elements 3*a* and cannot be conveyed by the platen roller 11 over an expected master making distance, causing a reduced image to be formed in the stencil 12, as stated earlier.

Why the above sticking occurs will be discussed hereinafter. As for the coefficient of friction $\mu$ of the surface of the base 12*b* and the surface smoothness of the film 12*a*, the stencil 12 with the synthetic fiber base 12*b* and the master 12 with the natural fiber base 12*b* compare, as follows. When the natural fiber base 12*b* is assumed to have a coefficient of friction $\mu$ of 1 on its surface, the synthetic fiber base 12*b* has a smaller coefficient friction $\mu$ of about 0.8. Further, the surface smoothness of the film 12*a* depends on the diameter of the fibers forming the base 12*b*. Specifically, natural fibers constituting the natural fiber base 12*b* have a greater diameter than synthetic fibers constituting the synthetic fiber base 12*b* and render the surface of the base 12*b* irregular. This, coupled with the film 12*a* adhered to the natural fiber base 12*b*, makes the surface smoothness of the film 12*a* lower than the film 12*a* adhered to the synthetic fiber base 12*b*. Consequently, the stencil 12 with the synthetic fiber base 12*b* is higher in the surface smoothness of the film 12*a* than the stencil 12 with the natural fiber base 12*b*. This presumably reduces the conveying force of the platen roller 11 due to a decrease in the coefficient of friction of the base 12*b* of the synthetic fiber stencil 12 contacting the platen roller 11 and an increase in the surface smoothness of the film 12*a* of the same stencil 12.

As for the reduction or contraction of an image, the stencil 12 selectively melted by heat sticks to the surface of the head 40 and obstructs conveyance. Therefore, when the stencil 12 is conveyed over a long distance while exerting a load on conveyance, the master making distance increases accordingly. Because the effective nip width LA of the conventional master making section is between about 1.4 mm and about 4.0 mm, the stencil 12 having been perforated is conveyed by about 0.7 mm to about 2.0 mm. The stencil 12 presumably sticks to the head 40 while being conveyed over the distance of 0.7 mm to 2.0 mm, causing a reduced image to be formed in the stencil 12.

The reduction of an image is more aggravated as the number of the heat generating elements 3*a* energized at the same time increases in the main scanning direction S, i.e., as the printing ratio of one line of the head 40 increases due to a heavier load to act on conveyance. In addition, the reduction of the entire image (absolute amount: contraction of one line x number of lines) increases with the number of pixels to be perforated in the subscanning direction or direction of stencil conveyance F.

None of the previously discussed four measures (1) through (4) proposed against the above problems in the past is satisfactory.

Preferred embodiments of the master making device in accordance with the present invention will be described hereinafter. In the illustrative embodiments, the same or similar structural elements are designated by identical reference numerals and will not be repeatedly described in order to avoid redundancy. As for structural elements provided in pairs, only one of them will be described.

For better understanding the illustrative embodiments, the planar thermal head 40, which is a specific form of a thin film thermal head, will be described more specifically. The head 40 includes the heat generating elements 3*a* connected in parallel to the common electrode 7, as described with reference to FIGS. 1 through 3. Therefore, when n heat generating elements 3*a* are energized at the same time, the composite resistance Ro is small, as well known in the art. Assuming that all the n heat generating elements 3*a* energized at the same time have the same resistance r Ω, then the composite resistance Ro is r/n Ω. In this manner, the composite resistance Ro decreases with an increase in the number of heat generating elements 3*a* energized at the same time. It follows that resistance ascribable to the wiring of the common electrode 7 shown in FIG. 2 is not negligible, resulting in the so-called common drop. To reduce the influence of the common drop, it has been customary to divide the heat generating elements 3*a* into some blocks, e.g., two blocks, four blocks or eight blocks so as not to drive all of them at the same time, or to correct energy to be fed in accordance with the number of elements 3*a* to be energized at the same time. However, because such an implementation is not satisfactory alone, the common electrode 7 is provided with a great volume (sectional area). For this purpose, in the head 40 of the conventional master making device, the edges of the heating bodies 3*a* are positioned on the thin film substrate 5 at a distance L of 2 mm to 12 m m from the end face 5*a* of the substrate 5 in the subscanning direction F. The end face 5*a* is located at a stencil outlet side F1 where the stencil 12 leaves the head 40.

Why the effective nip width LA is selected to be 1.4 mm to 4.0 mm will be described with reference to FIGS. 3, 5A through 5C, 6 and 7. Assume that the conventional head 40, FIG. 3, perforates the stencil or thermosensitive medium 12. Then, it is a common practice to press one of the head 40 and platen roller 11 against the other and transfer heat from the heat generating elements 3*a* to the stencil 12, thereby forming an image in the stencil 12. Generally, the platen roller 11 has a diameter of 12 m m to 24 mm and causes a pressure of 1.5 N/cm to 3.5 N/cm to act. In this condition, the nip width between the circumference Ha of the platen roller 11 and the top 40*a* of the head 40 has a minimum value determined by the worst combination, i.e., the diameter of the platen roller 11 of 12 m m and the pressure of 1.5 N/cm. The maximum nip is determined by the diameter of the platen roller of 24 mm and the pressure of 3.5 N/cm.

Of course, the effective nip width LA between the platen roller 11 and the head 40 in the subscanning direction F exists which allows the heat of the heating bodies 3*a* to be satisfactorily transferred to the stencil 12. It is known from experience that the effective nip width LA, like the above nip width, decreases with a decrease in the diameter and pressure of the platen roller 11.

Figure 5A:
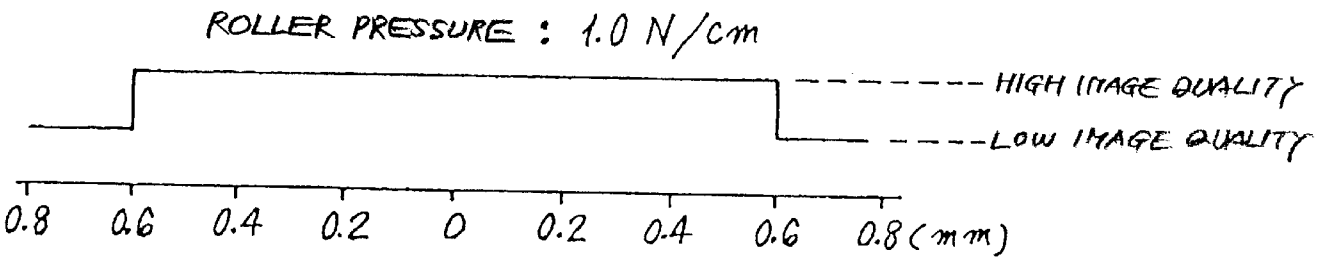
FIGS. 5A through 5C each show a relation between the image quality and the nip width with respect to a particular platen roller pressure.
Figure 5B:
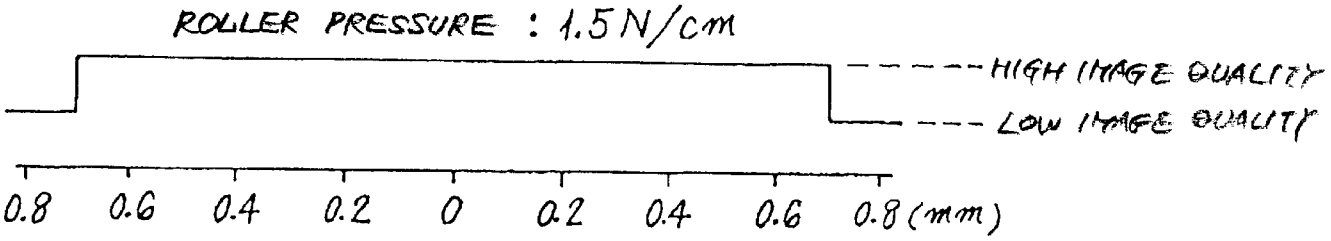
Figure 5C:
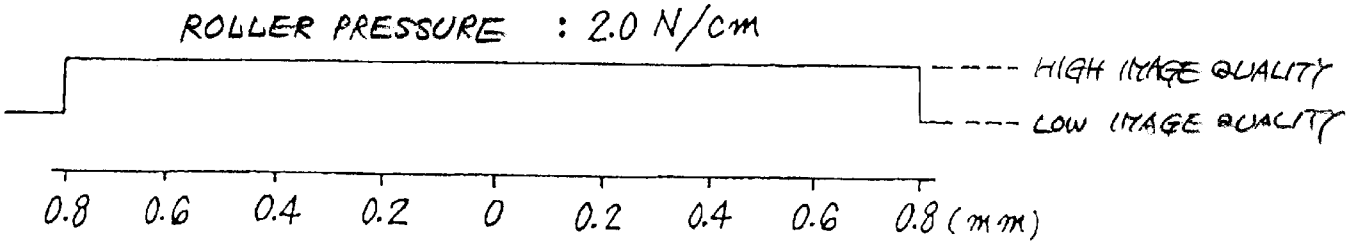
Figure 6:
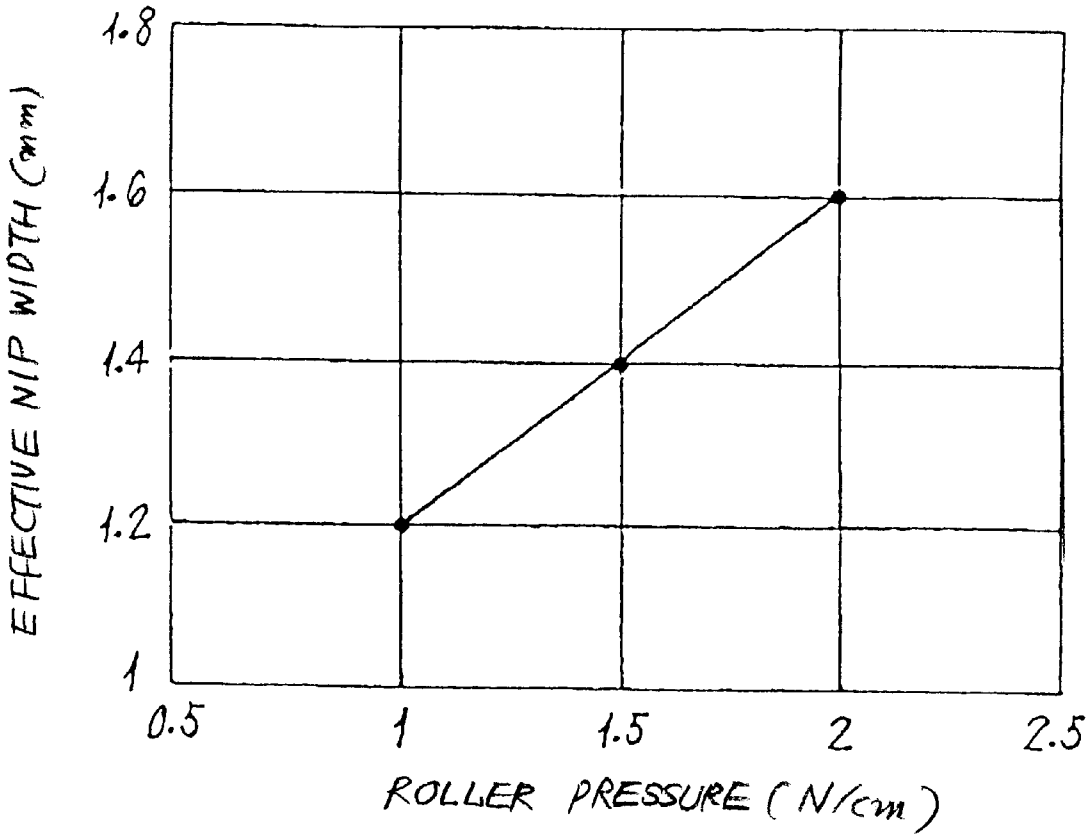
FIG. 6 is a graph showing a relation between the platen roller pressure and the effective nip width.

Experiments were conducted to determine a relation between the pressure of the platen roller 11 and the effective nip width LA with respect to the diameter of the roller 11 minimizing the effective nip width LA, as follows. FIG. 3 shows a specific condition in which the platen roller 11 presses a thermosensitive medium m (distinguished from the stencil 12 by a parenthesis) against the head 40. In this condition, the platen roller 11 was shifted in position to the right and the left of the head 40 little by little in the subscanning direction F. How heat was transferred from the heat generating elements 3*a* to the medium m was determined at each position of the platen roller 11 in terms of the visual condition of the resulting image. FIGS. 5A through 5C show the results of the experiments. In FIGS. 5A through 5C, the abscissa indicate the distance (mm) by which the platen roller 11 was shifted relative to the head 40 in the subscanning direction; the center of the nip width implemented an acceptable image was selected to be 0 mm. FIG. 6 is a graph showing a relation between the pressure of the platen roller 11 (N/cm) and the effective nip width (mm) derived from the results of FIGS. 5A through 5C; the abscissa and ordinate indicate the pressure (N/cm) and effective nip width (mm), respectively.

By the same method, it is possible to determine a relation between the pressure of the platen roller 11 and the effective nip width LA with respect to the diameter of the roller 11 of 24 mm and the pressure of the roller of 3.5 N/cm.

For the above experiments, the thermosensitive medium m was implemented by an ordinary photosensitive paper for use with, e. g., a printer associated with a word processor.

One platen roller 11 had a diameter of 12 m m, a silicone rubber thickness of 2 mm (core diameter of 8 mm), and a rubber hardness HS (JIS A) of 43°. The other platen roller 11 had a diameter of 24 mm, a silicone rubber thickness of 6 mm (core diameter of 12 m m), and a rubber hardness HS of 43°. Each heat generating element 3*a* of the head 40 was sized 50 μm (direction S)×60 μm (direction F) in the dimensions shown in FIG. 2. So long as each heat generating element 3*a* is sized not greater than 120 μm (direction S)×140 μm (direction), it is sufficiently smaller than the effective nip width LA and therefore not critical, even taking account of errors in experiments.

The above experimental results show that an effective nip width of about 1.4 mm is guaranteed in the subscanning direction F of the head 40 even with the diameter of the platen roller 11 of 12 mm and the pressure of the same of 1.5 N/cm, which is the worst combination minimizing the effective nip width. Also, the experimental results show that an effective nip width of about 4.0 mm is achievable in the direction F with the diameter of the roller 11 of 24 mm and the pressure of the same of 3.5 N/cm, which is the combination maximizing the effective nip width. It follows that the effective nip width of a master making section included in the conventional digital stencil printer is between about 1.4 mm and about 4.0 mm. As shown in FIG. 6, when the pressure of the roller 11 having the diameter of 12 m m was varied, the effective nip width linearly varied in accordance with the pressure.

For the above experiments, the head 40 may, of course, be shifted to the right and the left of the platen roller 11 little by little in the subscanning direction F relative to the roller 11. Further, not only the conventional head 40 but also heads included in the illustrative embodiments to be described may be used.

It will be seen from the above that the effective nip width varies in accordance with the pressure and specification (diameter, rubber hardness and rubber thickness) of the platen roller 11. In light of this, it has been customary to arrange the heat generating elements 3*a* of the head 40 at the center of the effective nip width LA of the platen roller 11. With this arrangement, it is possible to form an acceptable image without regard to the combination of the pressure and diameter of the platen roller 11.

Figure 7:
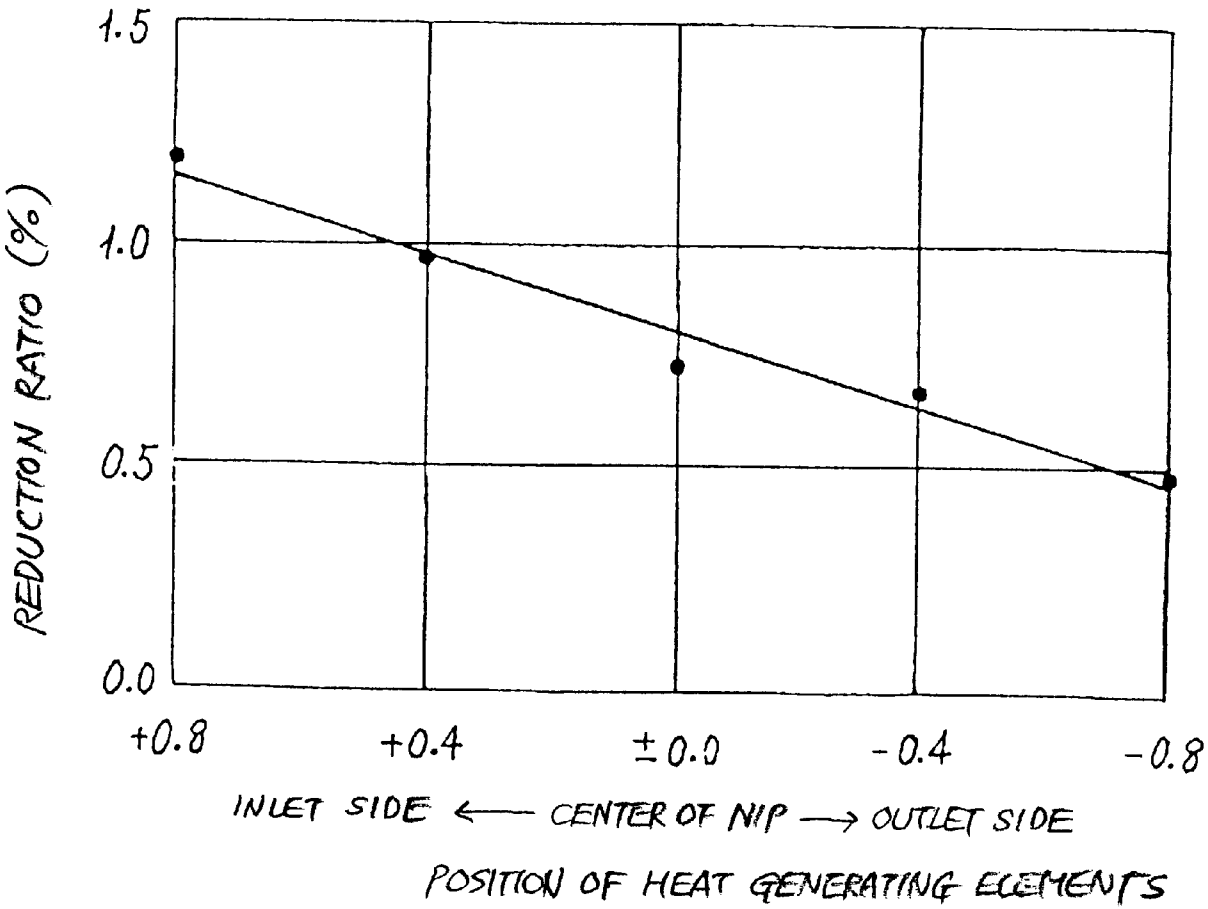
FIG. 7 is a graph for describing the reduction ratio of a solid image formed in a stencil.

Reference will be made to FIG. 7 for describing the reduction ratio or contraction ratio of an image formed in the stencil 12 including the synthetic fiber base 12*b*. Specifically, FIG. 7 shows experimental results representative of a relation between the reduction ratio of the above stencil 12 in the subscanning direction and the position of the heat generating elements 3*a* in the effective nip width. For experiments, a solid image in the form of dots was formed in the stencil 12 over an area of 293 mm (direction S)×420 mm (direction F). The reduction ratio was determined relative to the amount of feed of the stencil 12, which was fresh, in the subscanning direction F. In FIG. 7, the abscissa indicates the position of the heat generating elements 3*a* in the effective nip width and shows that the elements 3*a* are shifted toward the stencil outlet side F1 from the left to the right of the abscissa. That is, the distance over which the stencil 12 is conveyed by being nipped between the platen roller 11 and the head 40 sequentially decreases from the left to the right of FIG. 7. The ordinate indicates, when the stencil 12 was conveyed by 420 mm in the subscanning direction F, how much the conveying distance of the perforated stencil 12 decreased relative to the conveying distance of the fresh stencil 12.

As FIG. 7 indicates, the reduction ratio increases with an increase in the distance over which the stencil 12 is conveyed by being nipped between the platen roller Hand the head 40 and with a decrease in the conveying distance before perforation. It is therefore readily estimated that the perforated stencil 12 adheres to the surface of the heat generating elements 3*a* via the protection film 1 and exerts a load on conveyance. Further, it is easily known from experience that the above load and therefore the amount of reduction increases with an increase in the number of heat generating elements 3*a* to be driven at the same time, and that the amount of reduction of the entire image, i.e., the previously mentioned absolute amount increases with an increase in the number of pixels to be formed in the direction of stencil conveyance.

The heat generating elements 3*a* should therefore preferably be located at a position where the perforated stencil 12 with the synthetic fiber base 2*b* is conveyed little by being nipped between the platen roller 11 and the head 40, i.e., at the outside side of the effective nip width. Alternatively, the heat generating elements 3*a* should preferably be located as close to the end face of the thin film substrate of the head 40 (ideally at a distance of 0 mm).

1st Embodiment

Figure 8:
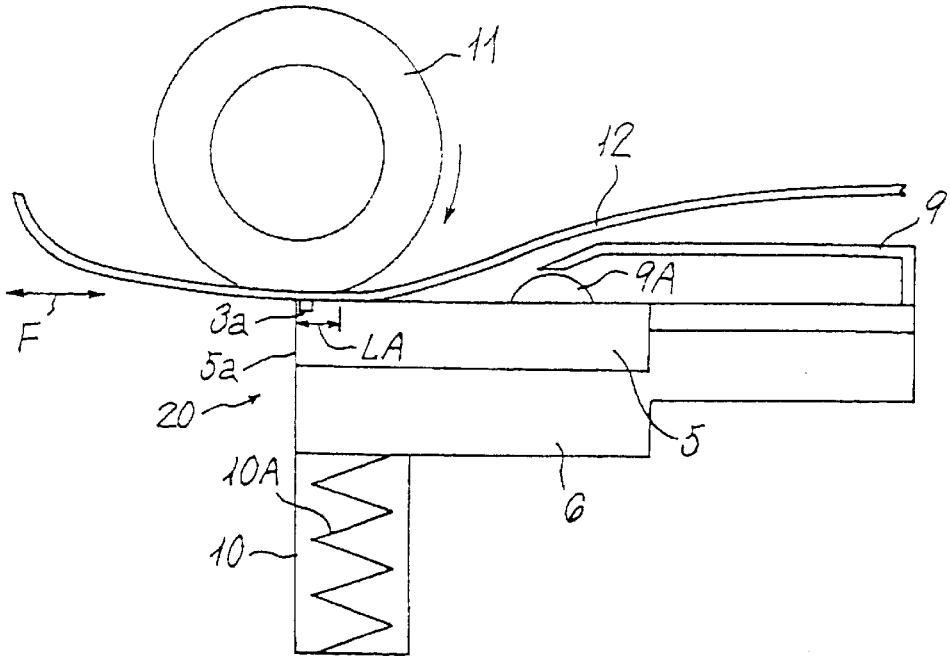
FIG. 8 is a fragmentary front view showing a first embodiment of the present invention.
Figure 9:
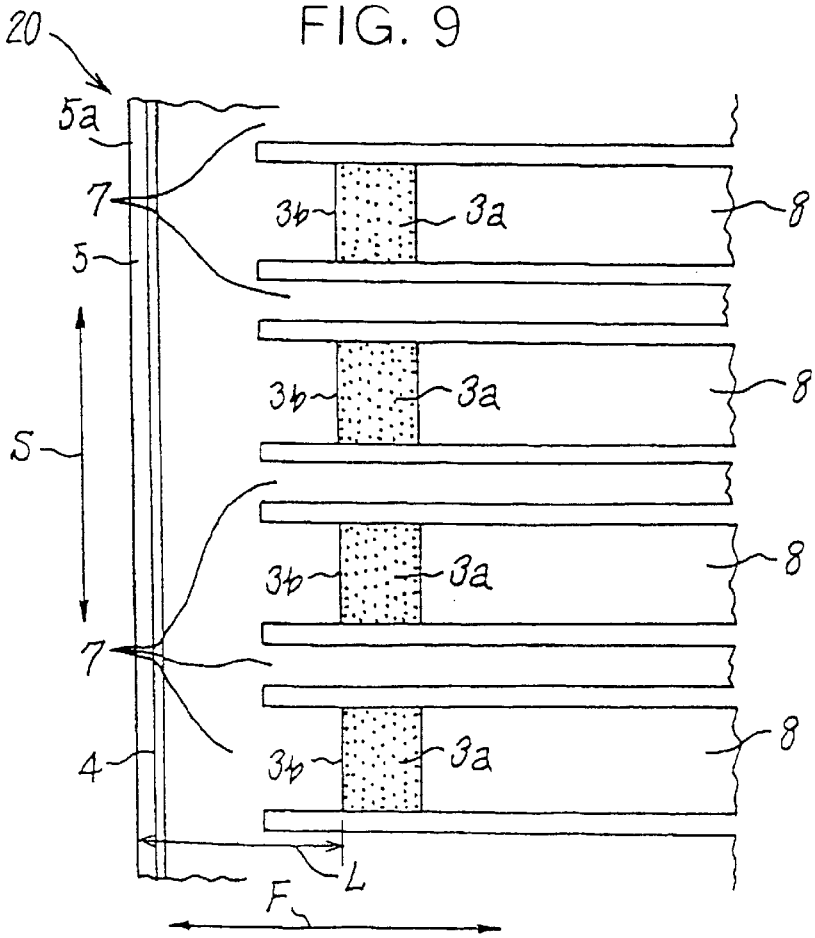
FIG. 9 is a fragmentary plan view showing the arrangement of heat generating elements, a common electrode and discrete electrodes constituting a real edge type thermal head included in the first embodiment.

Referring to FIGS. 8 and 9, a first embodiment of the master making device in accordance with the present invention will be described. As shown in FIG. 8, the master making device includes a real edge type thermal head 20. This embodiment is identical with the conventional master making device of FIG. 3 except for the substitution of the real edge type thermal head 20 for the planar thermal head 40.

As shown in FIGS. 8 and 9, the head 20 includes a heat insulating layer or glaze layer 4 formed of glass and printed on the upper surface of a thin film substrate 4, and a heat radiator 6. The reference numerals 9 and 9A designate a protection cover and protection resin, respectively. There are also shown in FIGS. 8 and 9 a platen roller 11, and a stencil 12 including a synthetic fiber base. Let this kind of stencil 12 be referred to as a synthetic fiber base stencil hereinafter.

As shown in FIG. 8, the platen roller 11 is formed integrally with a shaft via a metallic core. The shaft has its opposite ends journal led to a front and a rear side plate, not shown, included in the master making device, as viewed in the direction perpendicular to the sheet surface of FIG. 8. In this condition, the platen roller 11 is rotatable clockwise, as seen in FIG. 8. A platen drive motor, not shown, is drivably connected to the platen roller 11 via a timing belt and gears or similar drive transmission members not shown. The platen drive motor is implemented by a stepping motor. Specifically, the rotation of the motor is transmitted to a feed roller pair via a tension roller pair and a solenoid-operated clutch located at the downstream side in the direction of stencil conveyance, although not shown in FIG. 8 or 9. The platen roller 11 is provided with a specification lying in the previously stated range.

The head 20 extends in parallel to the shaft of the platen roller 11. Moving means including a pressing mechanism 10 selectively presses the head 20 against the platen roller 11 with the intermediary of the synthetic fiber base stencil 12.

For details of the rest of the configuration of the master making device and printer body including it, reference may be made to Japanese Patent Laid-Open Publication No. 8-67061 mentioned earlier.

Again, the synthetic fiber base stencil or medium 12 is made up of a porous base 12*b*, a thermoplastic resin film 12*a*, and an adhesive layer 12*c* adhering them together, as described with reference to FIG. 4. In the illustrative embodiment, the entire base 12*b* is implemented by synthetic fibers of, e.g., PET while the film 12*a* is formed of polyester resin and has a thickness t1 of 1.5 μm. The entire laminate has a thickness t3 of 25 μm to 30 μm. The PET fibers of the base 12*b* have a uniform diameter as small as 4 μm to 11 μm and are combined as if they were woven vertically and horizontally.

Figure 10A:
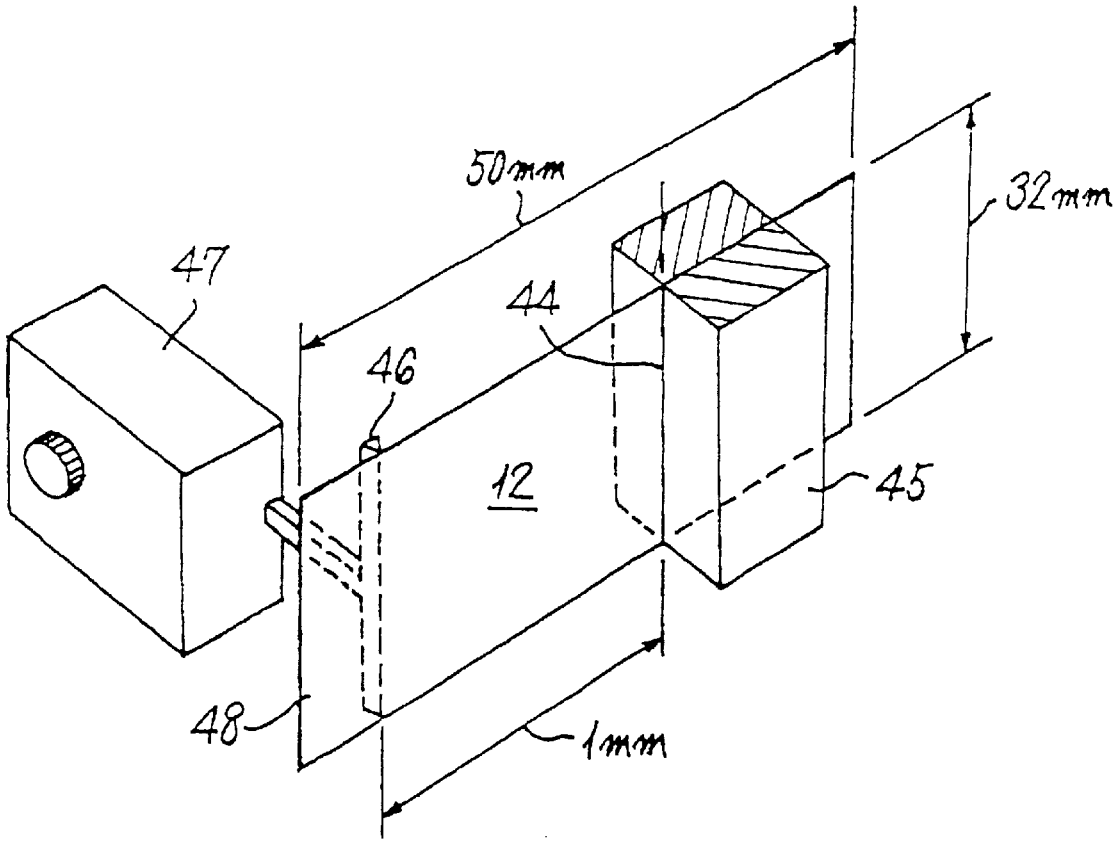
FIGS. 10A and 10B are respectively a perspective view and a plan view, showing a specific tester for measuring the rigidity of a stencil.
Figure 10B:
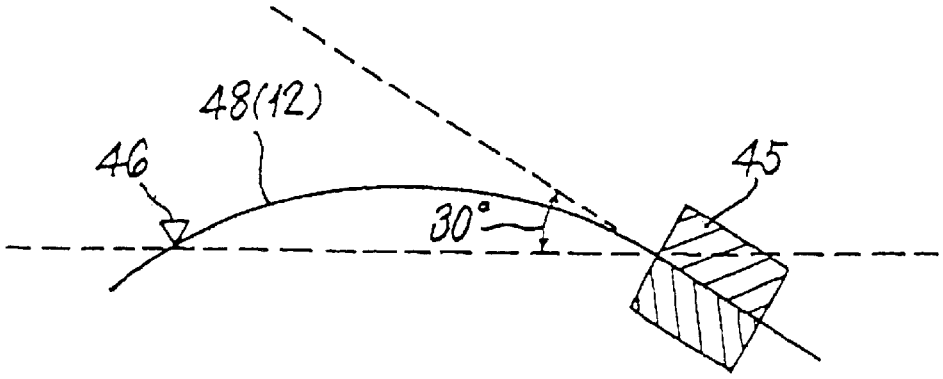

The conventional stencil 12 and synthetic fiber stencil 12 were compared with respect to bending rigidity (or simply rigidity) by use of an L & W rigidity tester available from Lorentzen & Wettre, Inc. FIGS. 10A and 10B show the general construction of the L & W rigidity tester. As shown, a rectangular sample 48, which is the master 12 in this case, is sized 50 mm×32 mm and positioned horizontally long. A damper 45 clamps one end of the stencil 12 while a knife edge 46 is held in contact with the film side of the other end of the stencil 12. In this condition, the clamper 45 is turned about a vertical pivot axis 44 by 30°. The knife edge 46 receives a force resulting from the bend of the stencil 12 while a transducer 47 with a position adjusting screw and connected to the knife edge 46 measures the force acting on the knife edge 46.

The above measurement was effected under the following conditions:

| | |
|---|---|
| sample | 50 mm × 32 mm |
| measurement span | 1 mm |
| bending angle | 30° |
| bending rate | 5°/sec during measurement |

In FIG. 10A, the measurement span of 1 mm is exaggerated for easy understanding.

Vertical rigidity and horizontal rigidity were measured with each of the conventional stencil 12 and synthetic fiber base stencil 12 by use of the L & W rigidity tester. It is to be noted that when the stencil 12 is positioned in parallel to the direction of stencil conveyance, vertical rigidity and horizontal rigidity respectively refer to rigidity in the direction of stencil conveyance and rigidity in the widthwise direction of the stencil 12. For the conventional stencil 12, use was made of a 43 μm to 47 μm long laminate of a base containing 60% of flax and a 1.5 μm thick PET thermoplastic resin film laminated together.

conventional stencil 12 about 128/70 mN
(vertical/horizontal; millinewton)

synthetic fiber base stencil 12 about 35/22 mN

The synthetic fiber base stencil 12 is paid out from a stencil roll, not shown, and then cut at a preselected length by a cutter not shown. The pressure of the pressing mechanism 10 is variable on the basis of the length of the coil spring 10A.

The real edge type head 20 is similar in structure to the planar head 40, FIG. 1, except that it includes a common electrode 7 having a unique wiring pattern, as shown in FIG. 9. As shown, the wiring pattern of the common electrode 7 connected to the heat generating elements 3*a* is arranged in parallel between the elements 3*a*. This is successful to reduce the influence of the common drop when a plurality of heat generating elements 3*a* are energized at the same time. Moreover, such a common electrode 7 reduces the width of the wiring pattern, compared to the common electrode 7 of the planar head 40, so that the heat generating elements 3*a* can be located closer to the end face 5*a* of a thin film substrate 5. The head 20 has a heat insulation layer 4, a resistance layer 3, lead electrodes 2 and protection layer 1 sequentially laminated on the substrate 5.

However, the problem with the real edge type head 20 is that the heat generating elements 3*a* cannot have their edges 3*b* adjoining the end face 5*a* of the substrate 5 positioned on the substrate 5, i.e., at a distance L of 0 mm from the end face 5*a*, because the common electrode 7 is essential. This, coupled with limitations on the state-of-the-art fabrication of thin film thermal heads, limits the above distance L to 0.5 mm (minimum value). More specifically, the head 20 is produced by cutting the thin film substrate 5 by a cutting device not shown. Stated another way, the minimum distance L available between the above edges 3*b* of the heat generating elements 3*a* on the substrate 5 and the end face 5*a* of the substrate 5 in the subscanning direction F is 0.5 mm, taking account of burr appearing at the end face or cut end 5*a* and production method.

Assume that the above head 20 is applied to the master making device of a digital stencil printer. Then, wherever the heating bodies 3*a* may be positioned within the effective nip width LA, the maximum distance over which the synthetic fiber base stencil 12 is conveyed after perforation while being nipped between the platen roller 11 and the head 20 is not greater than 0.5 mm. That is, the distance over which the film 12*a* adheres to the heat generating elements 3*a* via the protection film, not shown, and exerts a load on conveyance is not greater than 0.5 mm. This is a drastic solution to the image reduction problem. Moreover, a desirable image can be reproduced at all times without regard to the perforation ratios (printing ratios) in the main scanning direction S and subscanning direction F or the amount of, e.g., PET contained in the base 12*b* of the synthetic fiber base stencil 12.

2nd Embodiment

Figure 12:
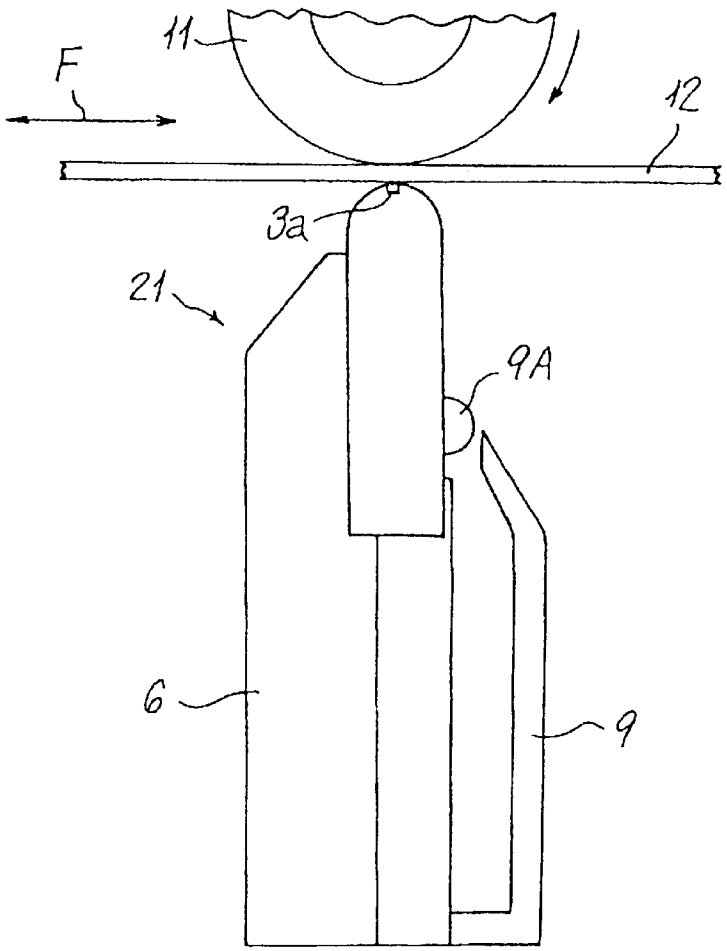
FIG. 12 is a fragmentary front view showing a thermal head and a platen roller included in the second embodiment.
Figure 11:
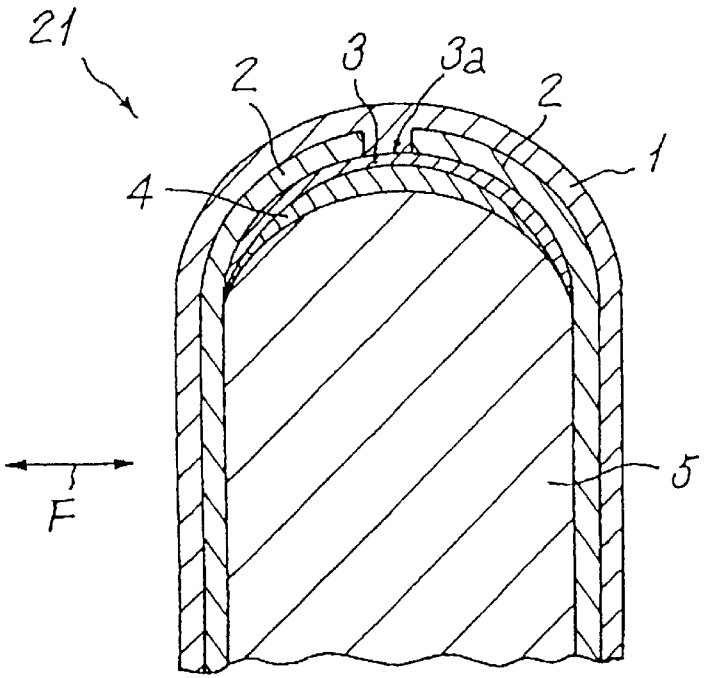
FIG. 11 is a fragmentary section showing an end face type thermal head representative of a second embodiment of the present invention.

A second embodiment of the master making device in accordance with the present invention is shown in FIGS. 11 and 12. As shown, this embodiment is also similar to the conventional master making device except for the substitution of a so-called end face type thermal head 21 for the planar thermal head 40.

There are shown in FIGS. 11 and 12 the protection resin 9A, protection cover 9, heat radiator 6, thin film substrate 5 formed of alumina ceramics, a heat insulation layer or glaze layer 4, resistance layer 3, heat generating elements 3*a* surrounded by the lead electrodes 2, and protection film 1. Current is fed to the heat generating elements 3*a* via the lead electrodes 2. The heat insulation layer 4, resistance layer 3, lead electrodes 2 and protection layer are sequentially laminated on the substrate 5 in this order.

The heat generating elements 3*a* are arranged in an array extending in the main scanning direction S on the generally U-shaped corner or end of the head 21, as illustrated. The head 21 is positioned substantially perpendicularly to the direction of stencil conveyance F.

In the above configuration, the heat generating elements 3*a* are spaced from the end of the substrate 5 at the outlet side F1 by about 1 mm in the subscanning direction F. More specifically, while the substrate 5 is 2 mm thick, the heat generating elements 3*a* are located at the center of the substrate 5. However, because the surface of the substrate 5 where the heat generating elements 3*a* are located has a curvature R of 1.2 mm, the actual distance over which the perforated stencil 12 is conveyed by being nipped between the platen roller 11 and the head 21 is about 0 mm to about 0.5 mm although dependent on the pressure. The master making device with such a head 21, of course, achieves the same advantages as the first embodiment.

3rd Embodiment

Figure 13:
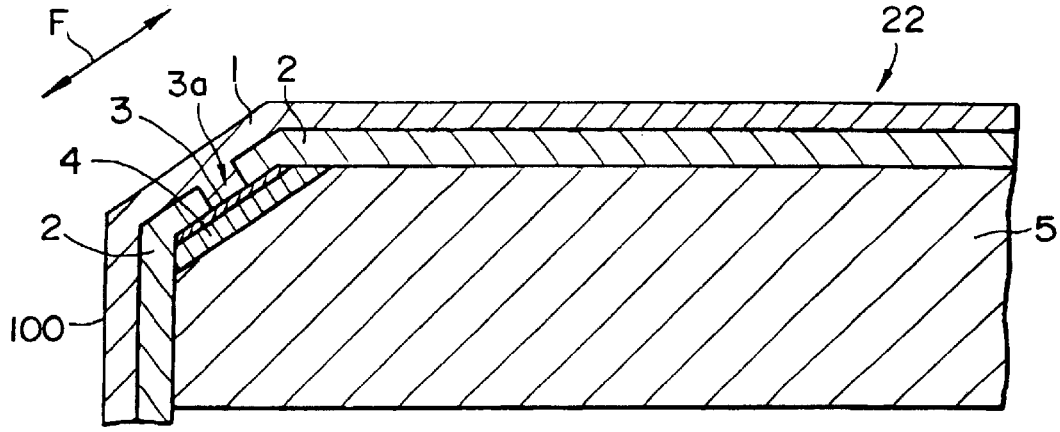
FIG. 13 is a section showing a corner edge type thermal head representative of a third embodiment of the present invention.

FIG. 13 shows a third embodiment of the master making device in accordance with the present invention. As shown, this embodiment includes a corner edge type thermal head 22 similar to the conventional planar thermal head 40 except that it has a unique section. There are shown in FIG. 13 the heat insulation layer or glaze layer 4, resistance layer 3, heat generating elements 3*a* surrounded by the lead electrodes 2, and protection layer 1. Current is fed to the heat generating elements 3*a* via the lead electrodes 2.

As shown in FIG. 13, a number of heat generating elements 3*a* are arranged in an array extending in the main scanning direction S at one corner of the corner edge type thermal head 22. In this type of head 22, too, the edges of the heat generating elements 3*a* adjoining the side end face 100 of the thermal head 22 are arranged at a distance of 0 mm to 0.5 mm from the side end face 100 of the thermal head 22 at the stencil outside side F1 in the subscanning direction F. The master making device with such a head 22, of course, achieves the same advantages as the first embodiment.

A guide and a platen roller, not shown, should preferably be located to face the corner or inclined surface of the head 22, so that the medium m or the stencil 12 can desirably contact the heat generating elements 3*a*. Particularly, when the medium m or the stencil 12 is relatively thick, the guide and platen rollers should preferably be capable of conveying the medium m.substantially in parallel to the inclined surface of the head 22, considering the elasticity of the medium m or that of the master 12. For this purpose, the head 22 may be substantially horizontally positioned, as shown in FIG. 13, in which case the medium m or the stencil 12 will be conveyed from the top right position of FIG. 13 substantially in parallel to the inclined surface of the head 22. Alternatively, the medium m or the stencil 12 may be substantially horizontally conveyed, in which case the head 22 will be held in an inclined position. Any one of such configurations may be selected in consideration of the size of the master making device, compatibility of the device with different kinds of master making devices, shared use of parts, and the quality or the kind of the medium m or that of the stencil 12.

4th Embodiment

Figure 14:
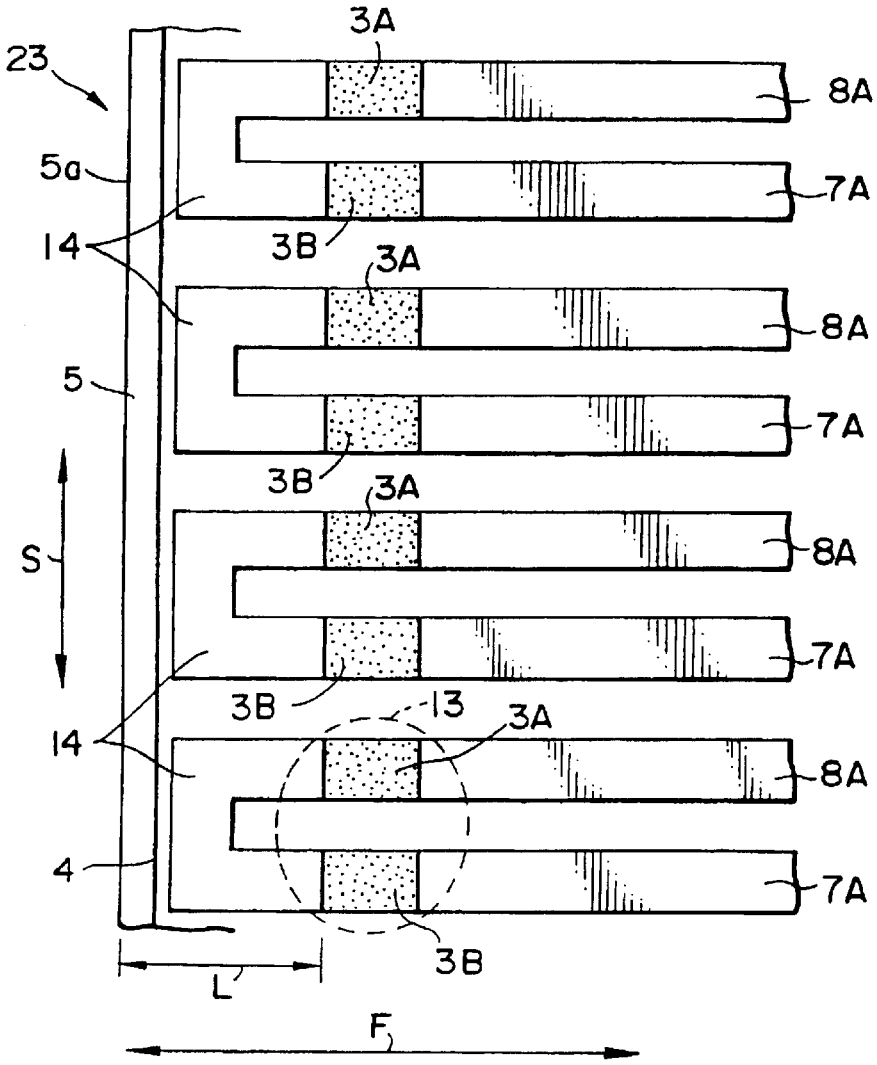
FIG. 14 is a plan view showing the arrangement of heat generating elements, a common electrode and discrete electrodes constituting a real edge type thermal head included in a fourth embodiment of the present invention.

Reference will be made to FIG. 14 for describing a fourth embodiment of the master making device in accordance with the present invention. As shown, this embodiment includes a linear edge type thermal head 23 identical with the head 20 of the first embodiment except for the arrangement of the heat generating elements and electrodes. There are also shown in FIG. 14 connecting electrodes 14 each connecting a particular pair of heating bodies 3A and 3B, as will be described specifically later, common electrodes 7A arranged in the main scanning direction S and connected to one of the heating bodies 3A and 3B provided in pairs, and discrete electrodes 8A connected to the other of the heating bodies 3A and 3B provided in pairs.

As shown in FIG. 14, while the head 23 is basically similar in section to the head 40 of the first embodiment, the head 23 has a unique wiring pattern not including the common electrode 7, FIG. 2, located at the outlet side F1 of the substrate 5. Each pair of heat generating elements 3A and 3B serially connected by a particular connecting electrode 14 constitute a single pixel 13, as indicated by a circle 13, and are assigned to a single image signal. This is successful to increase the resistance of the heat generating elements 3A and 3B and therefore to reduce the influence of the common drop.

Again, the problem with the real edge type head 23 is that the heating bodies 3A and 3B cannot have their edges adjoining the end face 5*a* of the substrate 5 positioned on the substrate 5 at the distance L of 0 mm from the end face 5*a*. This, coupled with limitations on the state-of-the-art fabrication of thin film thermal heads, limits the above distance L to 0.5 mm (minimum value). Stated another way, the head 23 is configured such that the above edges of the heating bodies 3A and 3B can be located on the substrate 5 at the minimum distance L of 0.5 mm from the end face 5*a* of the substrate 5 at the outside side F1. The master making device with such a head 23, of course, achieves the same advantages as the first embodiment.

5th Embodiment

Figure 15:
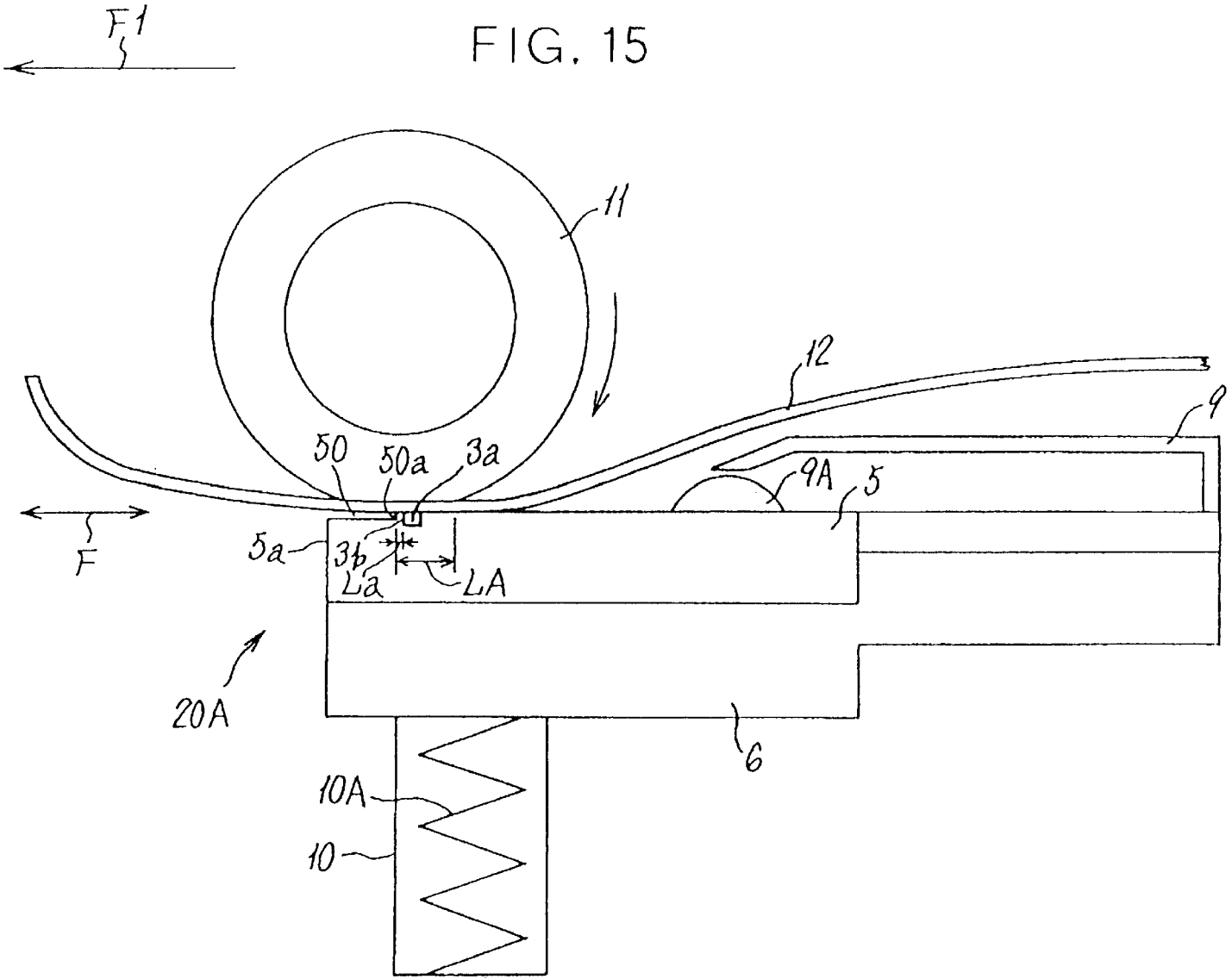
FIG. 15 is a fragmentary front view showing a real edge type thermal head and a platen roller included in a fifth embodiment of the present invention.
Figure 16:
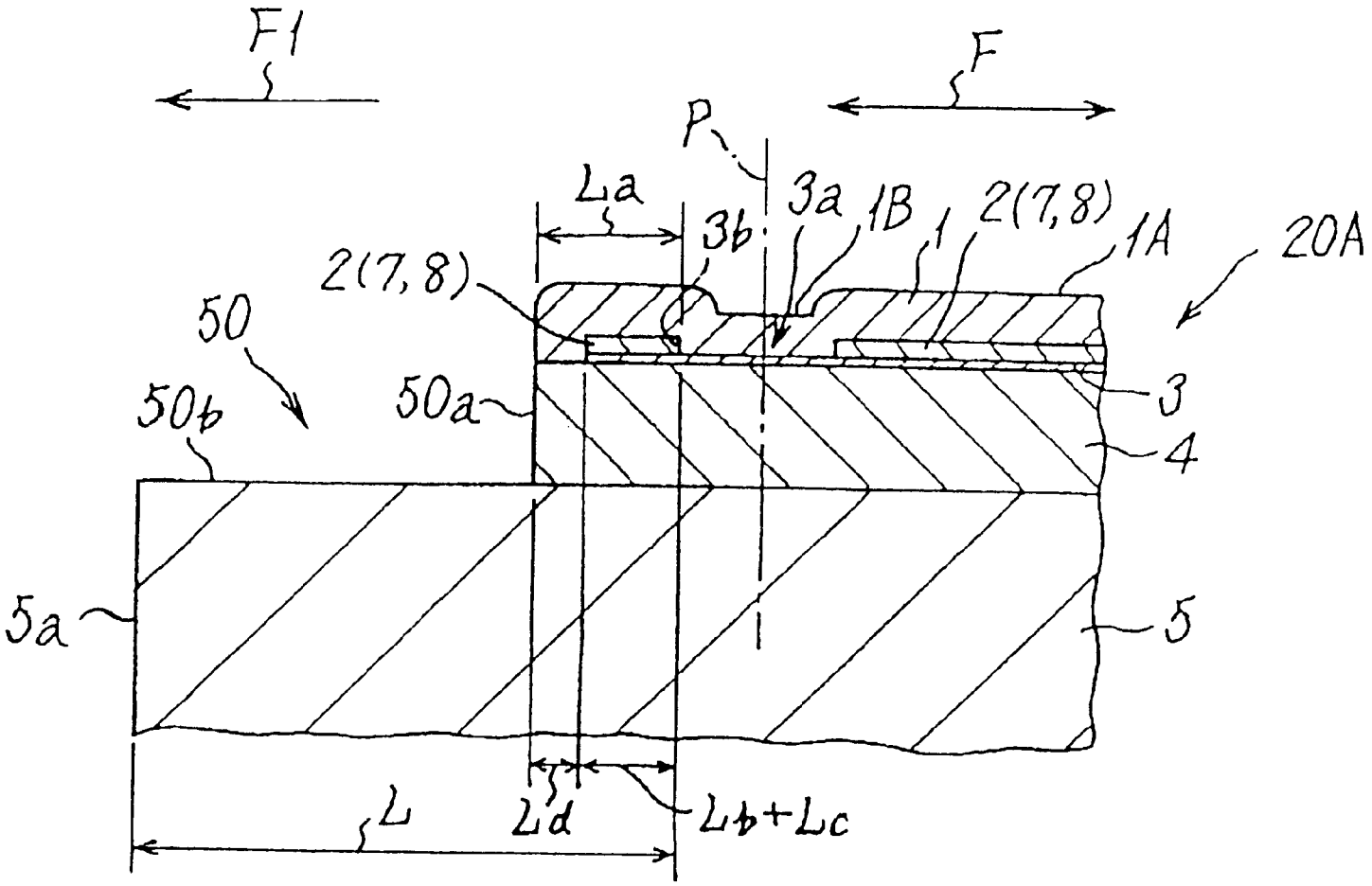
FIG. 16 is an enlarged section showing part of the head of the fifth embodiment including a stepped portion.
Figure 17:
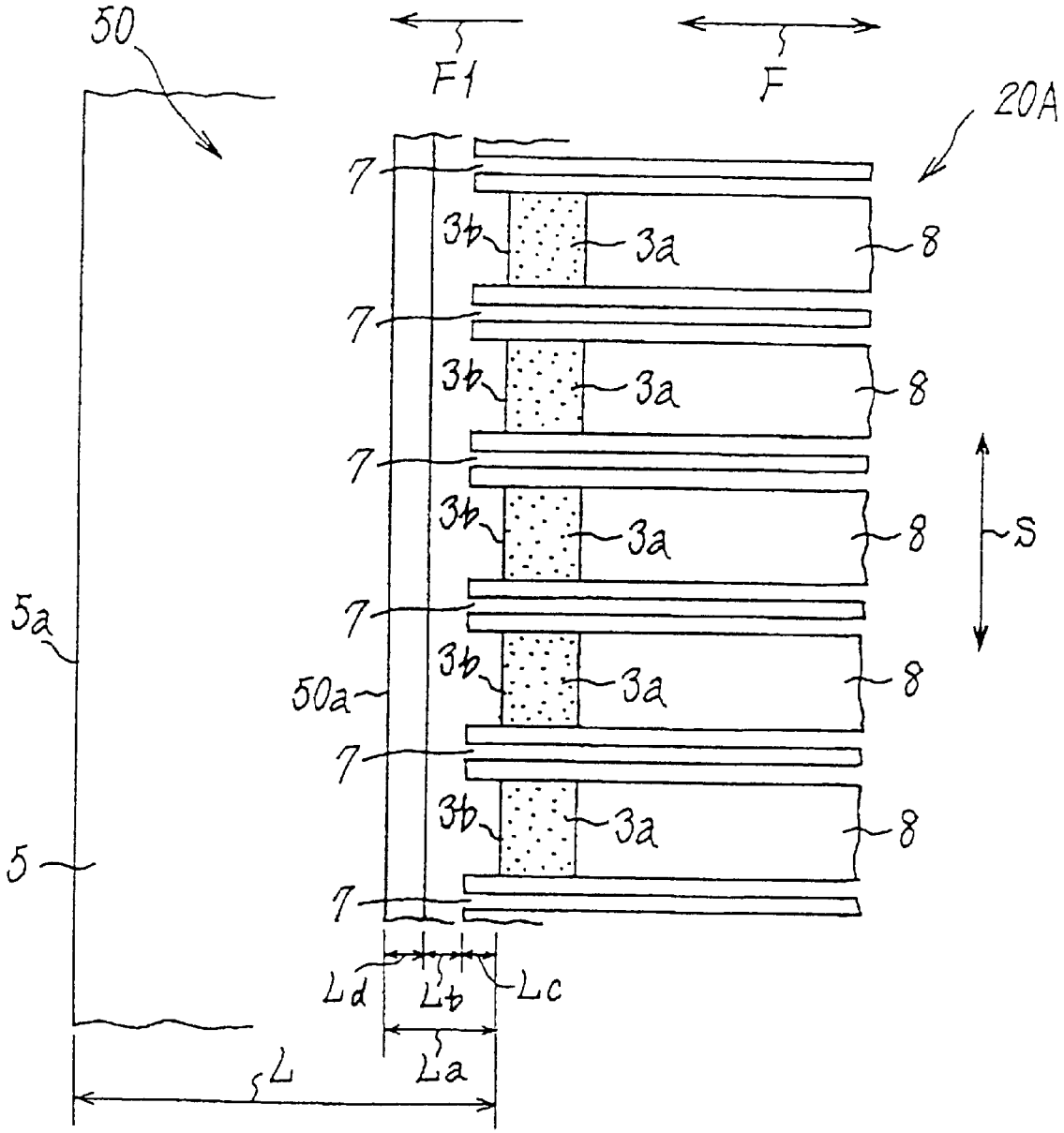
FIG. 17 is a fragmentary plan view showing the arrangement of heat generating elements, a common electrode and discrete electrodes constituting the head of the fifth embodiment.

Referring to FIGS. 15 through 17, a fifth embodiment of the master making device in accordance with the present invention will be described. As shown in FIG. 15, the master making device includes a real edge type thermal head 20A. This embodiment is identical with the conventional master making device of FIG. 3 except for the substitution of the real edge type thermal head 20A for the planar thermal head 40.

There are shown in FIGS. 15 through 17 the thin film substrate 5, heat insulation layer or glaze layer printed on the upper surface of the substrate 5 and formed of glass, heat radiator 6, protection cover 9, protection resin 9A, pressing mechanism 10, platen roller 11, and synthetic fiber base stencil 12. These constituents are identical with the constituents of the conventional master making device shown in FIGS. 1 through 3.

The head 20A extends in parallel to the shaft of the platen roller 11. Moving means including a pressing mechanism 10 selectively presses the head 20A against the platen roller 11 with the intermediary of the synthetic fiber base stencil 12. While the structure of the head 20A is basically similar in section to the structure of the head 40A, FIG. 1, the heat insulation layer 4, resistance layer 3, lead electrodes 2 and protection layer 1 are sequentially laminated on the thin film substrate 5 in this order, as shown in FIG. 16.

As shown in FIG. 17, the real edge type head 20A has a unique wiring pattern implementing the common electrode 7, as seen in a plan view. Specifically, the wiring pattern of the common electrode 7 connected to the heat generating elements 3*a* extends between the elements 3*a* in a parallel configuration. This is successful to reduce the influence of the common drop when a plurality of heat generating elements 3*a* are energized at the same time. Moreover, such a common electrode 7 reduces the width of the wiring pattern, compared to the common electrode 7 of the planar head 40, so that the heat generating elements 3*a* can be located closer to the end face 5*a* of the thin film substrate 5.

Again, the problem with the real edge type head 20A is that the heat generating elements 3*a* cannot have their edges adjoining the end face 5*a* of the substrate 5 positioned on the substrate 5 at the distance L of 0 mm from the end face 5*a*. In the illustrative embodiment, the head 20A is formed with a stepped portion 50 at the stencil outlet side F1 in the subscanning direction F. The edges 3*b* of the heat generating elements 3*a* located at the stencil outside side F1 are positioned at a distance of 0.018 mm to 0.5 mm from the end face 50*a* of the stepped portion 50 adjoining the edges 3*b*. As shown in FIG. 16, the head 20A is positioned such that the center of each heat generating element 3*a* lies on a vertical line P extending through the axis of the platen roller 11. It may therefore occur that the distance L between the end face 5*a* of the substrate 5 and the edges 3*b* of the heat generating elements 3*a* exceeds 0.5 mm.

As shown in FIG. 16, to locate the end face 50*a* of the stepped portion 50 as close to the heat generating elements 3 as possible, the substrate 5 is not cut by a cutting device not shown. Instead, in the illustrative embodiment, the protection film 1 and heat insulation layer 4 are etched toward the substrate 5 such that the stepped portion 50 extends to the end face 5*a* of the substrate 5.

The minimum distance of 0.018 mm between the edges 3*b* and the end face 50*a* of the stepped portion 50 is derived from the patterning process of the head 20A unique to the illustrative embodiment. Specifically, the resistance layer 3 implemented by a Ta alloy is deposited on the heat insulation layer 4 printed on the substrate 5. The common electrode 7 and discrete electrodes 8 implemented by aluminum are deposited on the resistance layer 3, constituting the lead electrodes 2. The above minimum distance of 0.018 mm is necessary for forming each of the above patterns by etching.

As shown in FIGS. 16 and 17, the substrate 5 is etched in order to form the pattern of the common electrodes 7 and discrete electrodes 8, the pattern of the heating bodies 3*a*, etc. The limit width necessary from the production standpoint is generally considered to be about 10 $\mu$m (0.01 mm) while the dimensional allowance is considered to be ±3 $\mu$m (0.03 mm). To form the pattern of the lead electrodes 2, the minimum distance Lb from the end face of the common electrode 7 must be 10 $\mu$m (0.01 mm) or 7 $\mu$m inclusive of allowance. The distance necessary for separating the heat generating elements 3*a* and electrode pattern, i.e., the minimum distance Lc between the edges 3*b* of the heat generating elements 3*a* and the end of the electrode pattern must be 7 $\mu$m like the minimum distance Lb. The Si—O—N protection layer 1 is deposited on the substrate 5 for protecting the electrodes from corrosion and the resistance layer 3 from oxidation which would occur if the heat generating elements 3 and electrodes were exposed to ambient air. In the illustrative embodiment, the protection layer 1 is about 4 $\mu$m thick. Because the protection layer 1 is, of course, necessary at the side adjoining the end face 50*a* of the stepped portion 50, it has a thickness Ld of about 4 $\mu$m as measured from the end face 50*a*. Consequently, the minimum distance La between the end face 50*a* and the edges 3*b* of the heat generating elements 3*b* in the subscanning direction F is 0.018 mm.

Why the maximum distance La between the end face 50*a* and the edges 3*b* of the heat generating elements 3*a* is 0.5 mm is that it is limited by a relation between the minimum effective nip width LA and the length of each heat generating element 3*a* in the subscanning direction F. That is, as FIG. 7 indicates, the expected effect is achievable if the distance La is 0.5 mm or less for the position of the heating bodies 3*a* of–0.5 mm and reduction ratio of 0.5% to 0.6%.

Figure 18:
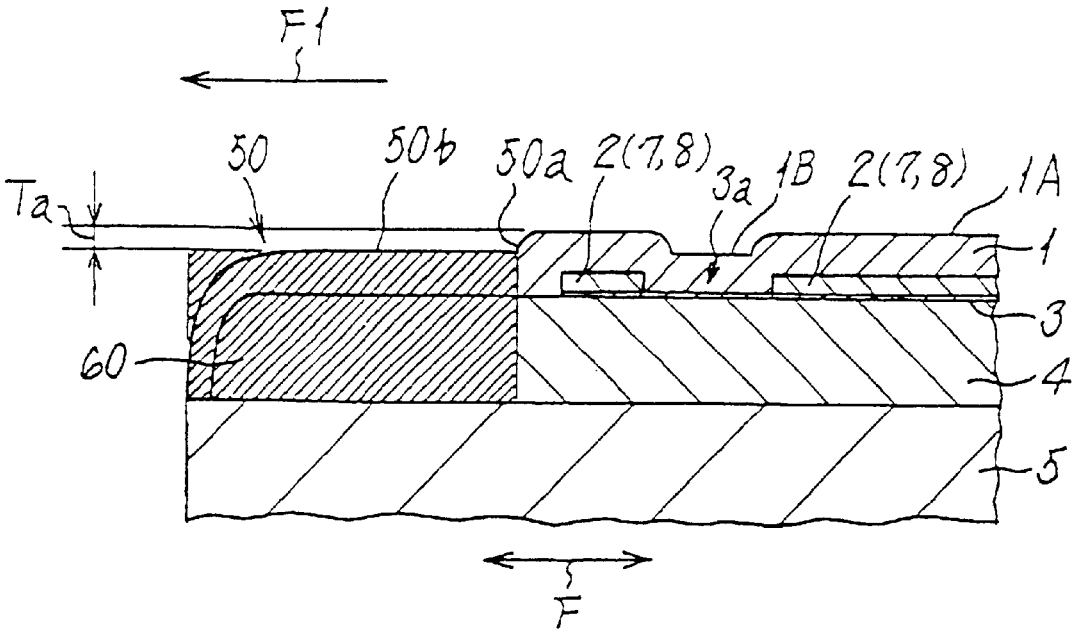
FIG. 18 is an enlarged section showing a relation between the highest position of the stepped portion and the upper surface of a protection layer unique to the fifth embodiment together with an etching region for forming the stepped portion.
Figure 19:
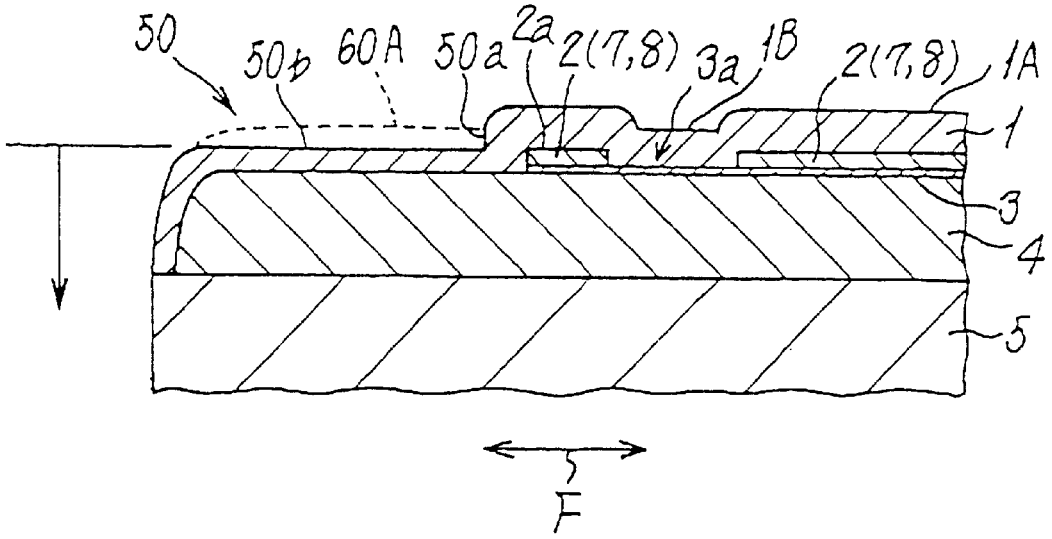
FIG. 19 is an enlarged section showing a relation between the highest position of the stepped portion and the upper surfaces of electrodes also unique to the fifth embodiment.
Figure 20:
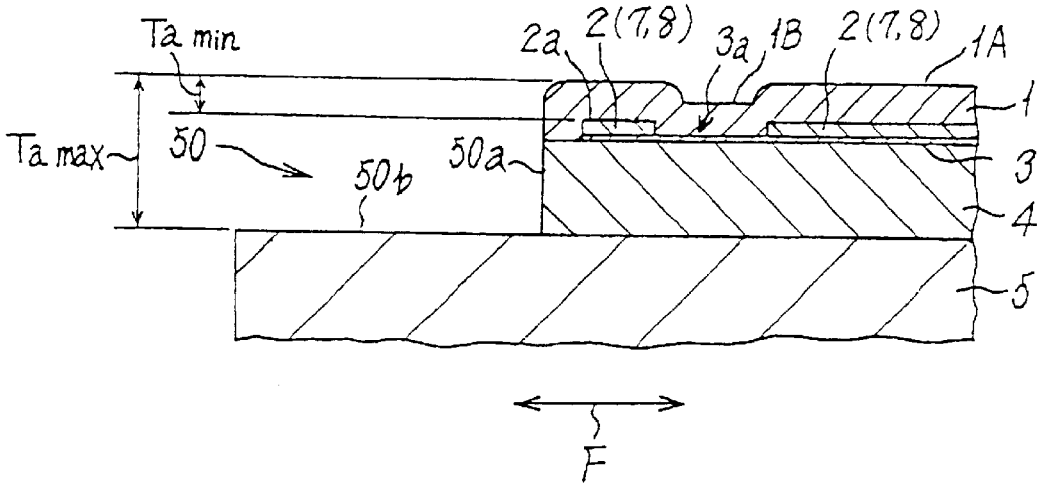
FIG. 20 is an enlarged section showing a relation between the maximum and minimum values of a difference in height of the stepped portion.

The position or height of the stepped portion 50 will be described specifically with reference to FIGS. 18 through 20. In the illustrative embodiment, the perforated synthetic fiber base stencil 12, FIG. 15, should only be conveyed by a minimum of distance by being nipped between the platen roller 11 and the head 20A. Basically, the upper surface 50*b* of the stepped portion should only be lower than the upper surface 1A of the protection film 1. In addition, the protection layer 1 formed on the lead electrodes 2 implements a difference in level Ta corresponding to the thickness (about 0.8 m) of the lead electrodes 2 between the portions where the lead electrodes 2 are present and the portions where they are absent. The stepped portion 50 can therefore be formed without resorting to etching. Alternatively, if the lead electrodes 2 are sufficiently thick, the protection layer land heat insulation layer 4 may be etched over a region 60 (indicated by hatching in FIG. 18) in order to form the stepped portion 50. More specifically, the stepped portion 50 shown in FIG. 18 has its upper surface 50*b* positioned at a level or height at least lower than the level of the lowermost portion 1B of the protection layer 1 which is the lower limit of the upper surface 1A of the layer 1. The lowermost portion 1B overlies the heat generating elements 3*a* at positions where the lead electrodes 2 are absent. This configuration prevents the upper surface 50*a* and synthetic fiber base stencil 12 from contacting each other when the platen roller 11 and head 20A are pressed against each other.

When the above difference Ta is simply equal to the thickness of the lead electrodes 2, it may occur that the synthetic fiber base stencil 12 or the platen roller 11 absorbs the difference Ta, depending on various conditions including the rigidity of the stencil 12 and the rubber hardness, thickness and pressure of the platen roller 11. In such a case, the protection film 1 may be etched to form the stepped portion 50, as indicated by a dashed line in FIG. 19. This can be easily done with high accuracy and efficiency because the level or height of the upper surface 50*b* is readily controllable by the order of several microns. Ideally, as shown in FIG. 19, the etching should be effected such that the upper surface 50*b* is lower in level than the upper surfaces 2*a* of the lead electrodes 2 formed on the substrate 5.

Specific dimensions of the various portions of the head 20A for implementing the difference Ta are as follows:

| | |
|---|---|
| protection layer thickness | 3.5 $\mu$m to 4.0 $\mu$m |
| lead electrode thickness | about 0.80 $\mu$m |
| resistance layer thickness | 400 Å |
| heat insulation layer thickness | 65 ± 10 $\mu$m (recommended by manufacture) |

Assume that the consecutive layers laminated on the substrate 5 are etched on the basis of the above numerical values in order to form the stepped portion 50. Then, as shown in FIG. 20, the difference Ta has a maximum value Tamax of 79.8 $\mu$m and a minimum value Tamin of 4.3 $\mu$m inclusive of allowance, i.e., 4.3 $\mu$m<Ta<79.8 $\mu$m. Here, the resistance layer thickness of 400 Å is not taken into account.

The head 20A applied to the master making device makes it needless to cut the substrate 5 and thereby enhances productivity while obviating the need for a cutting device. Further, the head 20A is free from burr and obviates an increase in cost ascribable to the extension of facilities while protecting the film 12*a* from damage. In addition, because the film 12*a* is free from damage, the waste of the synthetic fiber base stencil 12 is reduced.

Wherever the heat generating elements 3*a* of the head 20A may be positioned within the effective nip width LA, the stepped portion 50 at the stencil outside side F1 prevents the upper surface 50*b* from contacting the synthetic fiber base stencil 12 even when the platen roller 11 and head 20A are pressed against each other. Therefore, the maximum distance over which the stencil 12 is conveyed after perforation while being nipped between the platen roller 11 and the head 20 is not greater than 0.5 mm. That is, the distance over which the film 12*a* adheres to the heat generating elements 3*a* via the protection film 1 and exerts a load on conveyance is not greater than 0.5 mm. This is another drastic solution to the image reduction problem. Moreover, a desirable image can be reproduced at all times without regard to the perforation ratios (printing ratios) in the main scanning direction S and subscanning direction F or the amount of, e.g., PET contained in the base 12*b* of the stencil 12.

By controlling the difference Ta, it is possible to delicately adjust the pressure to act on the perforated stencil 12. This successfully reduces the load to act on the perforated stencil 12 and obviates the sticking of the stencil 12 more positively to thereby reduce the waste of the stencil 12.

Moreover, the illustrative embodiment differs from the previous first to fourth embodiments in that it does not have to give consideration to the distance between the end face 5*a* of the head and the edges 3*b* of the heat generating elements 3*a*. The head 20A is therefore easy to process and allows the above distance to be even greater than 0.5 mm because of the stepped portion 50.

6th Embodiment

Figure 21:
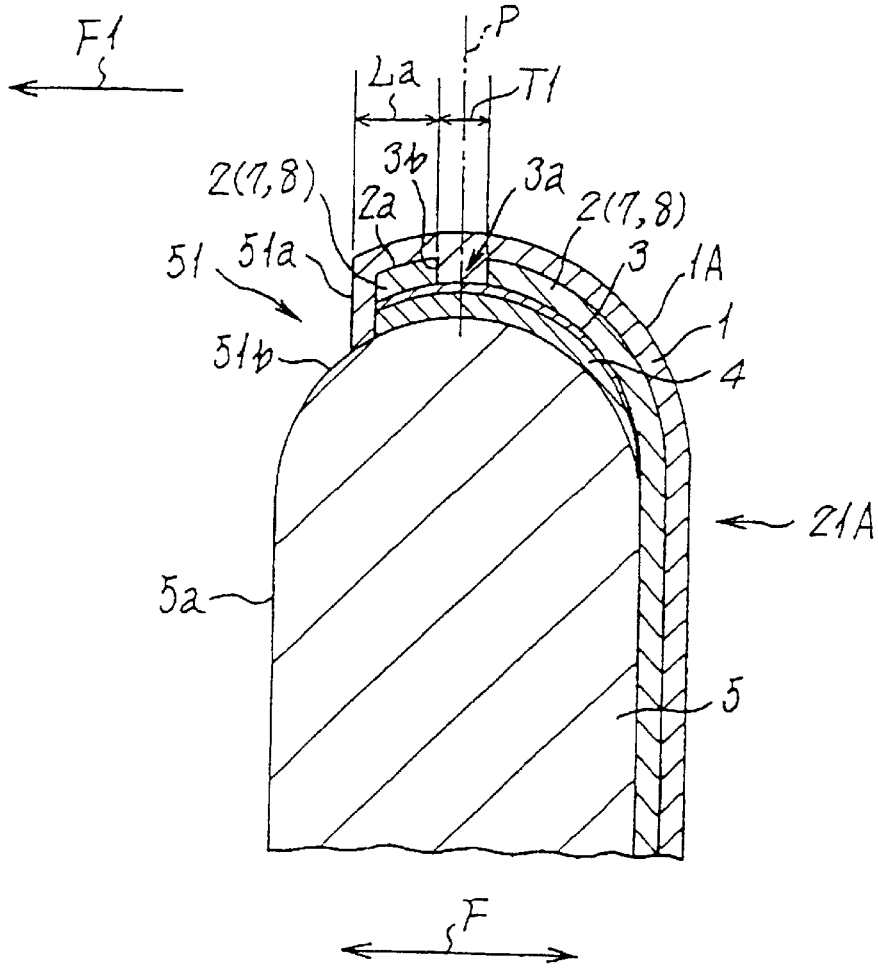
FIG. 21 is a fragmentary section of an end face type thermal head representative of a sixth embodiment of the present invention.
Figure 22:
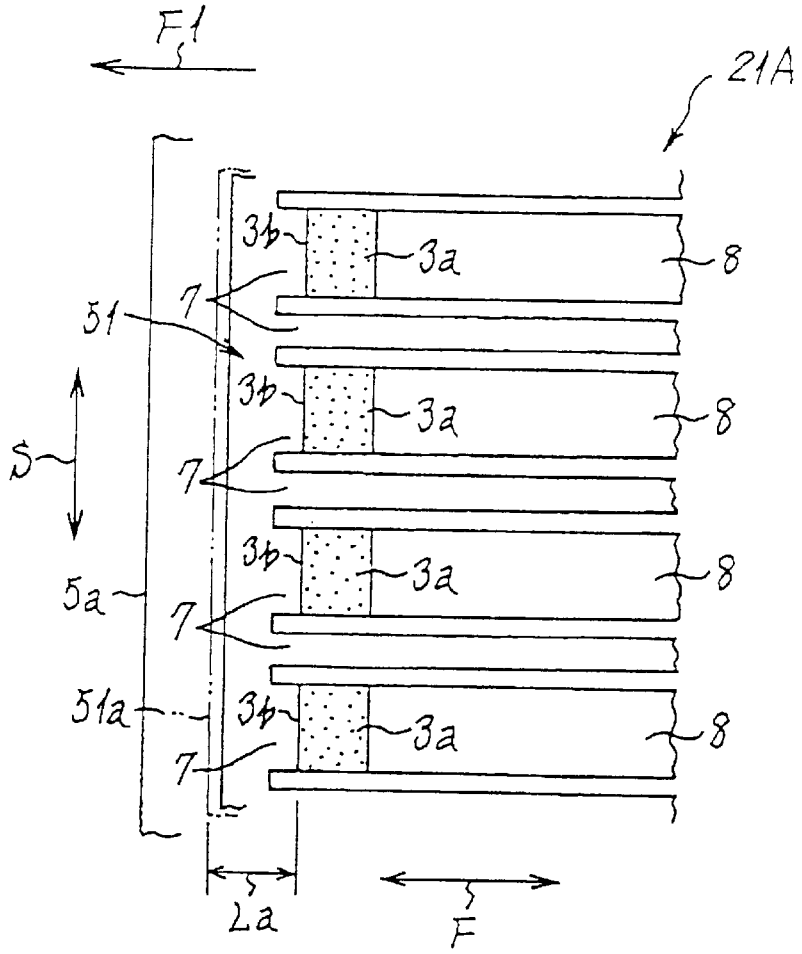
FIG. 22 is a plan view showing the arrangement of heat generating elements, a common electrode and discrete electrodes constituting the head of the sixth embodiment.

FIGS. 21 and 22 show a sixth embodiment of the master making device in accordance with the present invention and including an end face type thermal head 21A. This embodiment is identical with the conventional master making device of FIG. 3 except that the end face type thermal head 21A is substituted for the planar thermal head 40. FIG. 22 shows the head 21A in a slightly enlarged scale, compared to FIG. 21.

The head 21A is identical with the end face type thermal head 21 shown in FIGS. 11 and 12 except that it additionally includes a stepped portion 51. The protection resin 9A and protection cover 9 are not shown in FIGS. 21 and 22. The head 21 has the heat insulation layer 4, resistance layer 3, lead electrodes 2 and protection film 1 sequentially laminated on the thin film substrate 5 in this order.

As shown in FIG. 21, the head 21A has a generally U-shaped corner or end face. A number of heat generating elements 3*a* shown in FIG. 22 are arranged on the above corner in an array extending in the main scanning direction S. The head 21A is positioned perpendicularly to the direction of stencil conveyance F.

More specifically, the thin film substrate 5 is about 2 mm to 3 mm thick in the subscanning direction F and has an arcuate top. The heat insulation layer 4, resistance layer 3, lead electrodes 2 and protection layer 1 are sequentially formed on the arcuate top of the substrate 5 in this order. It follows that the arcuate surface of the substrate 5 on which the heat generating elements 3*a* are arranged has a curvature R of at least 2 mm. Each heat generating element 3*a* is located at a distance of about 1 mm to about 1.5 mm from the end face 5*a* of the substrate 5 in the subscanning direction F, i.e., located at the center of the substrate 5 in the direction F. In the illustrative embodiment, each heat generating element 3*a* has a length T1 of 100 $\mu$m (0.1 mm) or less in the subscanning direction F. The head 21A is positioned such that the center of each heat generating element 3*a* lies on a vertical line P extending through the axis of the platen roller not shown.

The head 21A has the stepped portion 51 formed at the stencil outlet side F1 in the subscanning direction F. To form the stepped portion 51, the arcuate surface of the substrate 5 is etched from the end face 5*a* toward the heat generating elements 3*a*. The upper surface 51*b* of the stepped portion, which is the highest position, is lower in level than the upper surface 1A of the protection layer 1, preferably lower than the upper surfaces 2*a* of the lead electrodes 2. Therefore, the lead electrodes, resistance layer 3 and heat insulation layer 4 are absent at the stencil outlet side F1 including the stepped portion 51. In the illustrative embodiment, too, the protection film 1 covers the etched ends of the resistance layer 3 and lead electrodes 2 in order to obviate corrosion and oxidation discussed previously. In this condition, the outer end of the protection film 1 forms the end face 51*a* of the stepped portion 51.

The distance La between the edges 3*b* of the heat generating elements 3*a* positioned at the stencil outside side F1 in the subscanning direction F and the end face 51*a* of the stepped portion 51 is selected to be 0.018 mm to 5 mm. Therefore, the actual distance over which the synthetic fiber base stencil 12 is conveyed by being nipped between the platen roller 11 and the head 21A is about 0.018 mm to 0.5 mm although dependent on the pressure. The head 21A with the above configuration achieves the same advantages as the head 21 of the fifth embodiment when applied to the master making device of a digital stencil printer.

7th Embodiment

Figure 23:
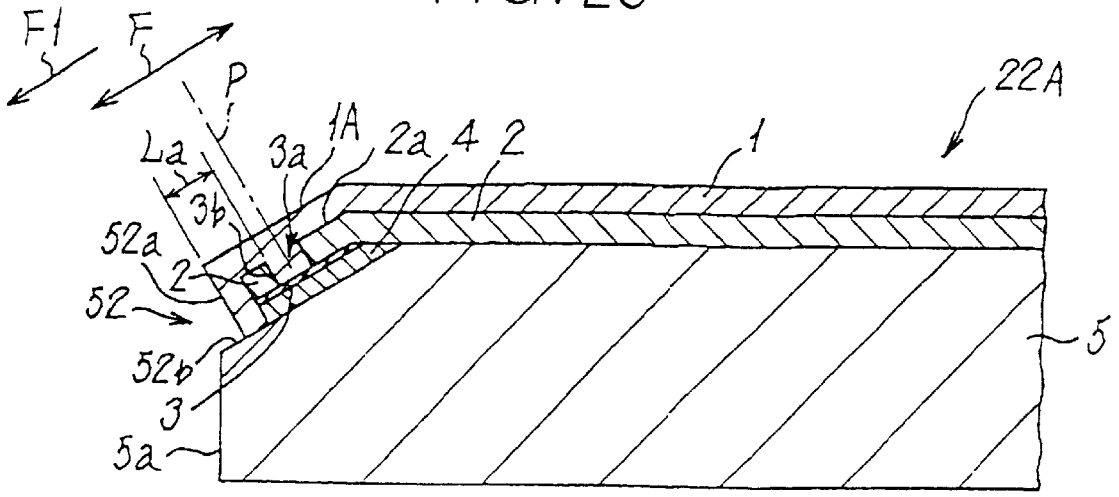
FIG. 23 is a fragmentary section showing a corner edge type thermal head representative of a seventh embodiment of the present invention.

FIG. 23 shows a seventh embodiment of the master making device in accordance with the present invention. As shown, this embodiment includes a corner edge type thermal head 22A similar to the conventional planar thermal head 40 except that it has a unique section. There are shown in FIG. 23 the thin film substrate 5 formed of alumina ceramics, heat insulation layer or glaze layer 4, resistance layer 3, heat generating elements 3*a* surrounded by the lead electrodes 2, and protection layer 1. Current is fed to the heat generating elements 3*a* via the lead electrodes 2.

As shown in FIG. 23, a number of heat generating elements 3*a* are arranged in an array extending in the main scanning direction S at one corner of the corner edge type thermal head 22A. The head 22A has a stepped portion 52 at the stencil outlet side F1 in the subscanning direction F. The stepped portion 52 is formed by etching the substrate 5 from the end face 5*a* toward the heat generating elements 3*a*. The upper surface 52*b* of the stepped portion 52, which is the highest position, is lower than the upper surface 1A of the protection layer 1, preferably lower than the upper surfaces 2*a* of the lead electrodes 2.

The distance La between the edges 3*b* of the heat generating elements 3*a* positioned at the stencil outside side F1 in the subscanning direction F and the end face 52*a* of the stepped portion 52 is also selected to be 0.018 mm to 5 mm. The head 22A with the above configuration achieves the same advantages as the head of the fifth embodiment when applied to the master making device of a digital stencil printer.

A guide and a platen roller, not shown, should preferably be located to face the corner or inclined surface of the head 22A, so that the medium m or the stencil 12 can desirably contact the heat generating elements 3*a*. Particularly, when the medium m or the stencil 12 is relatively thick, the guide and platen rollers should preferably be capable of conveying the medium m substantially in parallel to the inclined surface of the head 22A, considering the elasticity of the medium m or that of the stencil 12. For this purpose, the head 22A may be substantially horizontally positioned, as shown in FIG. 23, in which case the medium m or the stencil 12 will be conveyed from the top right position of FIG. 23 substantially in parallel to the inclined surface of the head 22A. Alternatively, the medium m or the stencil 12 may be substantially horizontally conveyed, in which case the head 22A will be held in an inclined position. Any one of such configurations may be selected in consideration of the size of the master making device, compatibility of the device with different kinds of master making devices, shared use of parts, and the quality or the kind of the medium m or that of the stencil 12.

8th Embodiment

Figure 24:
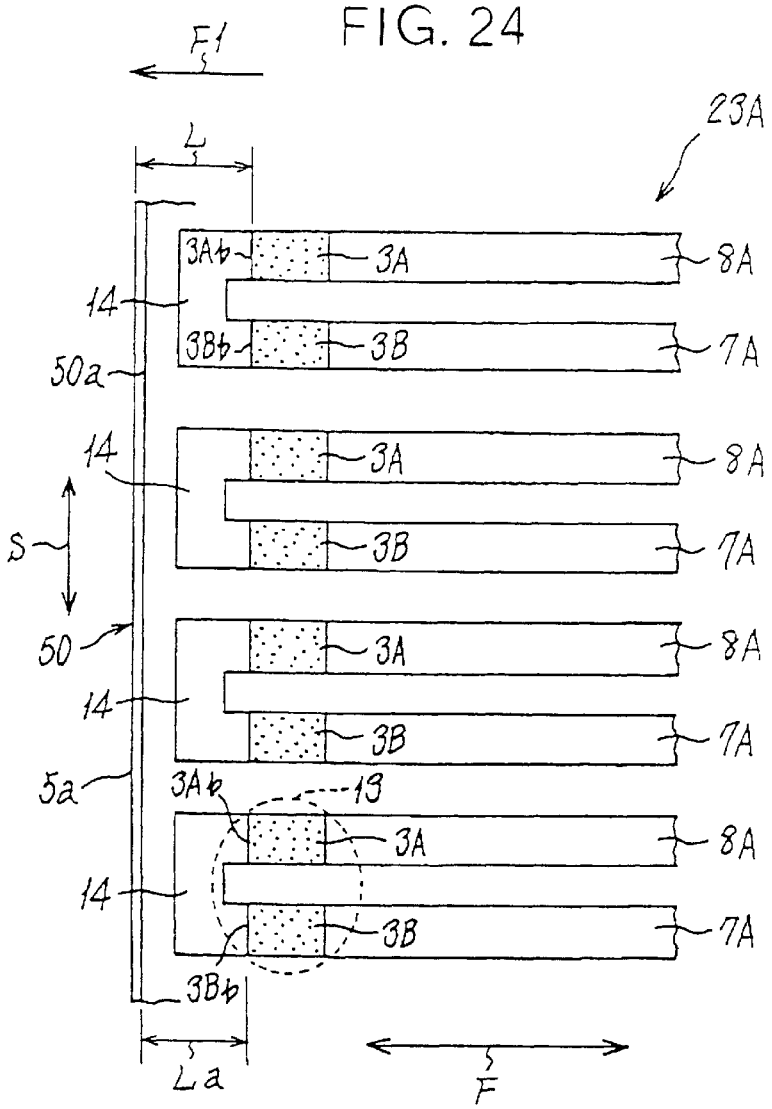
FIG. 24 is a fragmentary plan view showing the arrangement of heat generating elements, a common electrode and discrete electrodes constituting a real edge type thermal head included in an eighth embodiment of the present invention.

FIG. 24 shows an eighth embodiment of the master making device in accordance with the present invention and including a real edge type thermal head 23A. While the real edge type thermal head 23A is also mounted on the master making device of a digital stencil printer, it differs from the fifth embodiment as to the arrangement of heat generating elements and electrodes. There are also shown in FIG. 24 the connecting electrodes 14 each connecting a particular pair of heating bodies 3A and 3B, common electrodes 7A arranged in the main scanning direction S and connected to one of the heating bodies 3A and 3B provided in pairs, and discrete electrodes 8A connected to the other of the heating bodies 3A and 3B provided in pairs.

As shown in FIG. 24, while the head 23A is basically similar in section to the real edge type thermal head 20A, FIG. 15, the head 23A has a unique wiring pattern not including the common electrode 7, FIG. 2, located at the stencil outlet side F1 of the substrate 5. Each pair of heat generating elements 3A and 3B serially connected by a particular connecting electrode 14 constitute a single pixel 13, as indicated by a circle 13, and are assigned to a single image signal. This is successful to increase the resistance of the heat generating elements 3A and 3B and therefore to reduce the influence of the common drop.

The problem with the real edge type head 23A is that the heat generating elements 3A and 3B cannot have their edges adjoining the end face 5*a* of the substrate 5 positioned on the substrate 5 at the distance L of 0 mm from the end face 5*a*. In the illustrative embodiment, the head 23A has the stepped portion 50 formed by etching. Therefore, the edges 3Ab and 3Bb of the heat generating elements 3A and 3B should only be located such that the distance La between the end face 50*a* of the stepped portion 50 and the edges 3Ab and 3Bb is 0.018 mm to 0.5 mm. The head 23A with the above configuration achieves the same advantages as the head of the fifth embodiment when applied to the master making device of a digital stencil printer.

In the fifth to eighth embodiments shown and described, the distance La has a minimum value of 0.018 mm while the center of the heat generating elements 3*a*, 3A and 3B is substantially coincident with the axis of the platen roller 11. Therefore, if the effective nip width LA, FIG. 15, is 0.036 mm or above, the advantages of the stepped portions 50, 51 and 52 can be surely achieved.

Figure 25:
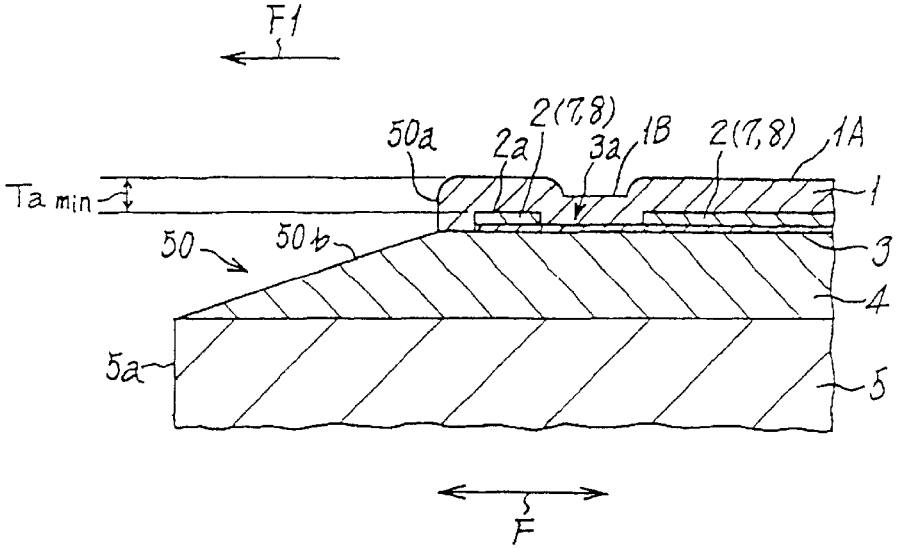
FIGS. 25 through 27 are enlarged sections each showing a particular modification of the stepped portion.

FIG. 25 shows another specific configuration of the stepped portion 50. As shown, the stepped portion 50 has an upper surface 50*b* inclined downward from the end face 50*b* of the portion 50 toward the end face 5*a* of the substrate 5. For this purpose, the heat insulation layer 4 may be etched from the protection film 1 side in such a manner as to form the stepped portion 50.

Figure 26:
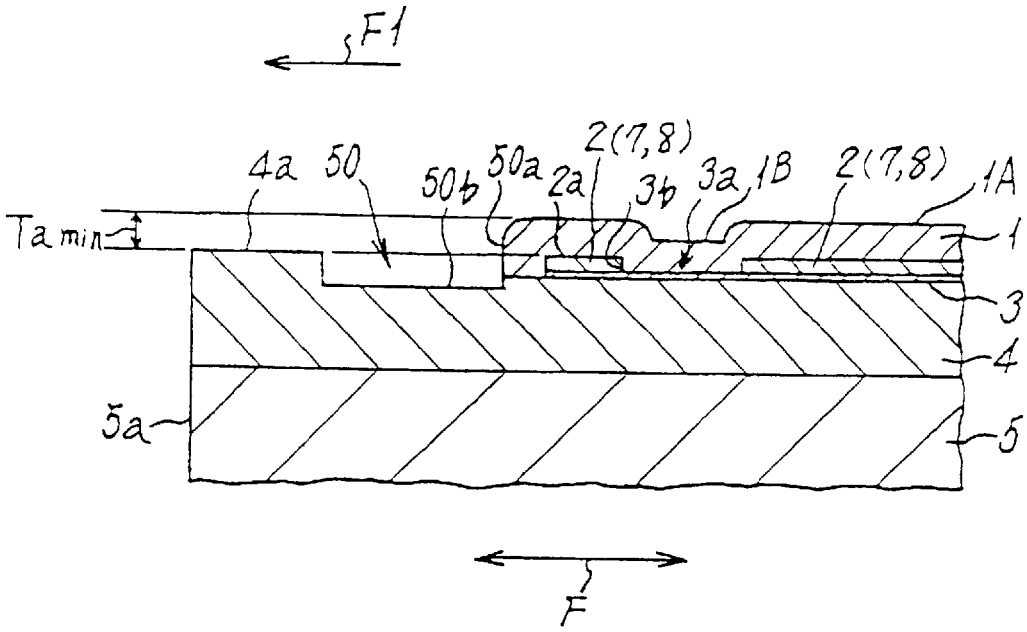

FIG. 26 shows still another specific configuration of the stepped portion 50. As shown, the stepped portion 50 is implemented as a recess not contiguous with the end face 5*a*. In this case, the edges 3*b* of the heat generating elements 3*a* are positioned by using the end face 50*a* of the recess adjoining the elements 3*a* as a reference. Further, as shown in FIG. 27, the stepped portion 50 may be implemented as an upward slant and a downward slant contiguous with each other.

Figure 27:
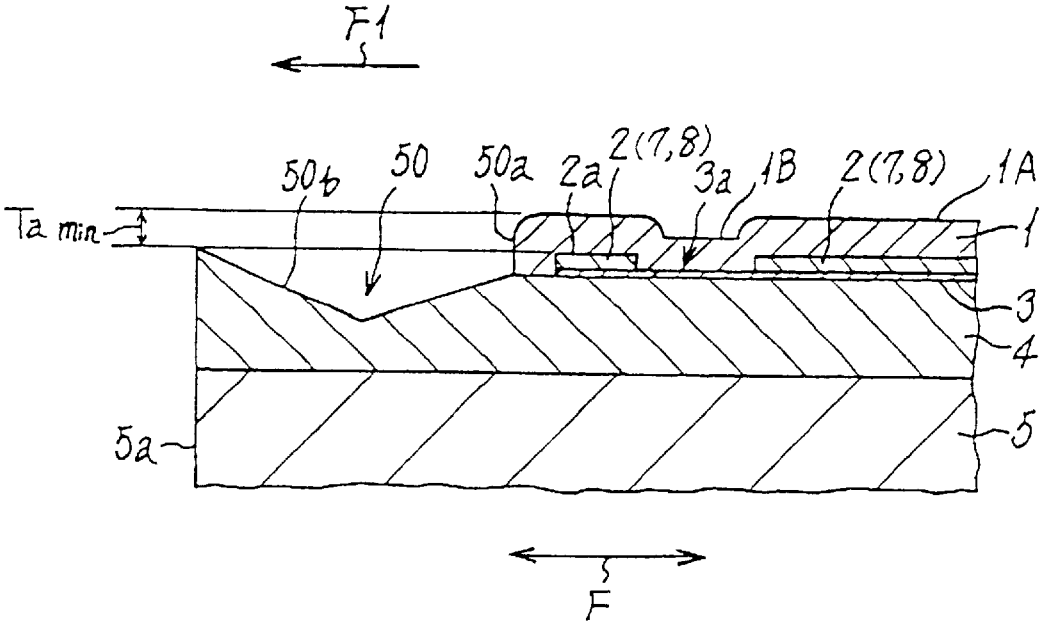

In any one of the configurations shown in FIGS. 25 through 27, the upper surface 50*b* of the stepped portion 50 should preferably be lower in level than at least the lowermost portion 1B of the upper surface 1A of the protection film 1, more preferably lower than the upper surfaces 2*a* of the lead electrodes 2. In the configuration shown in FIG. 26, the upper surface 4*a* of the heat insulation layer 4 should preferably be lower in level than at least the lowermost portion 1B of the upper surface 1A of the protection layer 1, more preferably lower than the upper surfaces 2*a* of the lead electrodes 2.

By adjusting the position of the upper surface 50*b* of the stepped portion 50 and that of the upper surface 4*a* of the heat insulation layer 4, as stated above, it is possible to prevent the surfaces 50*b* and 4*a* from contacting the stencil 12 more positively and therefore to obviate sticking. In this sense, the stepped portion 50 may have any desired configuration so long as it can prevent the surfaces 4*a* and 50*b* from contacting the stencil 12 and can therefore obviate a load otherwise acting on the stencil 12 during conveyance.

While the end portions of the stepped portions 50, 51 and 52 have been shown and described as being implemented as the end faces 50*a*, 51*a* and 52*a*, respectively, they do not have to be implemented as end faces.

The various advantages described above are achievable even with the conventional stencil or a stencil implemented substantially only by a thermoplastic synthetic resin film. It is to be noted that a stencil implemented substantially only by a thermoplastic resin film includes a stencil consisting of a thermoplastic synthetic resin film only, a stencil whose thermoplastic resin film contains a trace of, e.g., an antistatic agent, and a stencil including one or more overcoat layers or similar thin film layers formed on at least one of opposite major surfaces of a thermoplastic resin film.

If importance is not attached to improvement in the conveyance of a stencil, the platen drive motor included in the illustrative embodiments may be omitted and replaced with a stepping motor located at the downstream side in the direction of stencil conveyance. This stepping motor will be drivably connected to the tension roller pair, not shown, or the feed roller pair not shown, so that the platen roller 11 can be rotated by the stencil 12 being conveyed.

In summary, it will be seen that the present invention provides a master making device having various unprecedented advantages, as enumerated below.

(1) The edges of heat generating elements adjoining the end of a thin film substrate at a stencil outlet side are positioned on the substrate at a distance of 0 mm to 0.5 mm from the end of the substrate. It is therefore not necessary to position a thermal head with respect to an effective nip between it and a platen roller by a troublesome procedure. Also, the distance over which a perforated thermosensitive medium is conveyed by being nipped between the platen roller and the head is as short as 0 mm to 0.5 mm, obviating the reduction of an image ascribable to sticking.

(2) The head includes a stepped portion located at the stencil outlet side in the subscanning direction. In addition, the edges of the heat generating elements adjoining the stencil outlet side are located at a distance of 0.018 mm to 0.5 mm from the end of the stepped portion adjoining the above edges. With this configuration, the above advantage (1) is also achieved. Further, the stepped portion allows a reference position for locating the heat generating elements on the substrate to be shifted toward the end of the stepped portion. This makes it needless to cut the substrate and thereby obviates burr, which would damage the film surface of the medium, without lowering production efficiency or increasing cost. Consequently, the waste of the medium is reduced.

(3) By adjusting the uppermost position of the stepped portion, it is possible to further reduce a load to act on the medium after perforation and therefore to further reduce the reduction of an image ascribable to sticking.

(4) A desirable image with high resolution is insured.

Various modifications will become possible for those skilled in the art after receiving the teachings of the present disclosure without departing from the scope thereof.

What is claimed is:

1. A device for perforating a thermosensitive medium in accordance with an image signal to thereby make a master, said device comprising:

a thermal head including a plurality of heat generating elements arranged on a thin film substrate in an array in a main scanning direction;

lead electrodes provided on the thin film substrate and connecting said plurality of heat generating elements to an electric power source;

a protection layer provided on the thin film substrate to cover said heat generating elements and said lead electrodes;

a platen roller for pressing the thermosensitive medium against said thermal head while in rotation for thereby conveying said thermosensitive medium in a subscanning direction perpendicular to the main scanning direction, said plurality of heat generating elements selectively generating heat in accordance with the image signal to thereby perforate said thermosensitive medium;

said thermal head including a stepped portion at a medium outlet side in the subscanning direction, an upper surface of said stepped portion being positioned lower than an upper surface of a portion of said protection layer which covers said lead electrodes; and said plurality of heat generating elements each having an edge which adjoins an end of said stepped portion, a distance between the edge of each of said plurality of heat generating elements and said end of said stepped portion being limited such that said thermosensitive medium is prevented from sticking to said thermal head.

2. A device as claimed in claim 1, wherein the thermosensitive medium comprises a stencil made up of a thermosensitive resin film and a porous base containing at least synthetic fibers and permeable to ink.

3. A device as claimed in claim 2, wherein the thermosensitive medium comprises a stencil made up of a thermosensitive resin film and a porous base containing at least synthetic fibers and permeable to ink.

4. A device as claimed in claim 1, wherein said thermal head comprises any one of an end face type, a real edge type and a corner edge type thermal head.

5. A device as claimed in claim 1, wherein said stepped portion includes a highest portion lower in level than upper surfaces of electrodes formed on said thin film substrate.

6. A device as claimed in claim 5, wherein the thermosensitive medium comprises a stencil made up of a thermosensitive resin film and a porous base containing at least synthetic fibers and permeable to ink.

7. A device as claimed in claim 5, wherein said thermal head comprises any one of an end face type, a real edge type and a corner edge type thermal head.

8. A device as claimed in claim 7, wherein the thermosensitive medium comprises a stencil made up of a thermosensitive resin film and a porous base containing at least synthetic fibers and permeable to ink.

9. A device as claimed in claim 1, wherein said stepped portion has a height difference between 4.3 $\mu$m to 79.8 $\mu$m.

10. A device as claimed in claim 9, wherein the thermosensitive medium comprises a stencil made up of a thermosensitive resin film and a porous base containing at least synthetic fibers and permeable to ink.

11. A device as claimed in claim 9, wherein said thermal head comprises any one of an end face type, a real edge type and a corner edge type thermal head.

12. A device as claimed in claim 11, wherein the thermosensitive medium comprises a stencil made up of a thermosensitive resin film and a porous base containing at least synthetic fibers and permeable to ink.

13. A device as claimed in claim 1, wherein said thermal head comprises any one of an end face type, a real edge type and a corner edge type thermal head.

14. A device as claimed in claim 13, wherein the thermosensitive medium comprises a stencil made up of a thermosensitive resin film and a porous base containing at least synthetic fibers and permeable to ink.

15. A device as claimed in claim 1, wherein the thermosensitive medium comprises a stencil made up of a thermosensitive resin film and a porous base containing at least synthetic fibers and permeable to ink.

* * * * *

UNITED STATES PATENT AND TRADEMARK OFFICE

CERTIFICATE OF CORRECTION

PATENT NO. : 6,664,992 B1
DATED : December 16, 2003
INVENTOR(S) : Yasumitsu Yokoyama et al.

It is certified that error appears in the above-identified patent and that said Letters Patent is hereby corrected as shown below:

Column 3,
Line 18, change “bur” to -- burr --.

Column 5,
Line 32, change “gneerating” to -- generating --.

Column 6,
Line 6, change “12” to -- 12a --.

Column 8,
Line 24, change “Ha” to -- 11a --.

Column 10,
Line 1, change “Hand” to -- 11 and --.
Line 43, change “journal led” to -- journalled --.

Column 11,
Line 16, change “damper” to -- clamper --.

Signed and Sealed this

Thirteenth Day of July, 2004

JON W. DUDAS
*Acting Director of the United States Patent and Trademark Office*